US005217852A

United States Patent [19]

Morigaki et al.

[11] Patent Number: 5,217,852

[45] Date of Patent: Jun. 8, 1993

[54] COLOR IMAGE-STABILIZATION PROCESSING SOLUTION USED FOR PROCESSING A SILVER HALIDE COLOR PHOTOGRAPHIC MATERIAL AND A PROCESSING METHOD USING THE SAME

[75] Inventors: Masakazu Morigaki; Hiroshi Kawamoto; Yoshihiro Fujita; Shigeru Nakamura; Hiroyuki Watanabe; Morio Yagihara, all of Kanagawa, Japan

[73] Assignee: Fjui Photo Film Co., Ltd., Kanagawa, Japan

[21] Appl. No.: 802,565

[22] Filed: Dec. 5, 1991

[30] Foreign Application Priority Data

Dec. 7, 1990 [JP] Japan ..... 2-400906
Feb. 12, 1991 [JP] Japan ..... 3-38969
Feb. 12, 1991 [JP] Japan ..... 3-38995

[51] Int. Cl.[5] ..... G03C 7/40

[52] U.S. Cl. ..... 430/372; 430/428; 430/463

[58] Field of Search ..... 430/372, 428, 463

[56] References Cited

U.S. PATENT DOCUMENTS 2,487,446 11/1949 Kellog ..... 430/372
2,487,569 11/1949 Mackey ..... 430/463
2,579,435 12/1951 Mackey ..... 430/463
2,579,436 12/1951 Mackey ..... 430/463
3,801,322 4/1974 Shirasu et al. ..... 430/372
4,786,583 11/1988 Schwartz ..... 430/372
4,859,574 8/1989 Gormel ..... 430/372
4,975,356 12/1990 Cullinan et al. ..... 430/428

FOREIGN PATENT DOCUMENTS 2-153348 6/1990 Japan .
908136 10/1962 United Kingdom .
1392134 2/1973 United Kingdom .

*Primary Examiner*—Hoa Van Le
*Attorney, Agent, or Firm*—Sughrue, Mion, Zinn, Macpeak & Seas

[57] ABSTRACT

Disclosed is a color image-stabilization processing solution for a silver halide color photographic material containing at least one of (a) an N-methylol compound represented by the following formula (I):

(I)

wherein X represents a group of non-metallic atoms necessary to form a 1H-pyrazole ring or 1H-1,2,4-triazole ring together with the nitrogen atom; and (b) an N-methylol compound satisfying the condition that an equilibrium constant in water at room temperature is $2\times10^{-2}$. mol/liter or less and a formaldehyde-releasing rate constant is $1\times10^{-5}$ $sec^{-1}$ or more. This solution permits one to dispense formaldehyde and its attendant risks. Also disclosed is a method for processing silver halide color photographic materials using such a solution.

16 Claims, No Drawings

COLOR IMAGE-STABILIZATION PROCESSING SOLUTION USED FOR PROCESSING A SILVER HALIDE COLOR PHOTOGRAPHIC MATERIAL AND A PROCESSING METHOD USING THE SAME

FIELD OF THE INVENTION

The present invention relates to a color image stabilization processing solution used for processing a silver halide color photographic material (hereinafter referred to as a light-sensitive material) and a processing method therewith, particularly to a stabilization processing solution which contains formaldehyde having a reduced vapor pressure and can provide a dye image having an excellent stability and to a processing method therewith.

BACKGROUND OF THE INVENTION

In general, the fundamental steps for processing a color light-sensitive material are the color developing step and the desilvering step. In the color developing step, exposed silver halide is reduced with a color developing agent to generate silver and the oxidation developing agent reacts with a coupler to form a dye image. In the subsequent desilvering step, silver formed in the developing step is oxidized by the action of an oxidizing agent generally called a bleaching agent and is then dissolved with an agent for forming a complex ion of a silver ion, which is generally called as a fixing agent. After going through this desilvering step has been performed, only the dye images are formed on the color light-sensitive material.

Usually, after these steps, a washing processing is carried out to remove an unnecessary processing solution drainage.

In the case of a color paper and a reversal color paper, the processing is finished with the above steps and a drying step generally follows. In the processing of a color negative film and a reversal color film, a stabilizing step is necessary in addition to the above steps. It is well known that the stabilizing bath in the final step following these processing steps contains formaldehyde for the purpose of preventing fading of the magenta dye attributable to the magenta coupler remaining in the light-sensitive material after processing. A small quantity of formaldehyde vapor is generated when the stabilizing bath containing formaldehyde is prepared and a light-sensitive material having a stabilizing solution attached thereon is dried.

It is known that the inhalation of formaldehyde is harmful for the human body and the Japan Association of Industrial Health advises that the allowable concentration of formaldehyde in a working environment is 0.5 ppm. Therefore, the effort to reduce the concentration of formaldehyde in the stabilizing bath and replace formaldehyde with an alternative has been made to improve the working environment.

A hexamethylenetetramine compound is described in, for example, JP-A-63-244036 (the term "JP-A" as used herein means an unexamined published Japanese patent application), as an alternative for formaldehyde. The use of this compound reduces the concentration of formaldehyde, that is, the vapor pressure of formaldehyde, but it also restricts the desired anti-fading function of a magenta dye and causes a marked fading within several weeks even at room temperature.

On the other hand, many N-methylol compounds having the specific structure have been proposed. For example, U.S. Pat. Nos. 2,487,569 and 2,629,660 disclose N-methylol compounds of melamines; U.S. Pat. No. 2,579,435 discloses N-methylol compounds of urea or 2-oxapropylene urea; U.S. Pat. No. 2,487,446 and JP-B-45-8506 disclose N-methylol compounds of thiourea compounds; U.S. Pat. No. 2,579,436 and British Patent No. 684,540 disclose N-methylol compounds of hydantoins; British Patent No. 908,136 discloses N-methylol compounds of cyandiamides; U.S. Pat. No. 3,801,322 and JP-A-61-35447 disclose N-methylol compounds of guanidines; British Patent 1,392,134 discloses N-methylol compounds of morpholine or biuret compounds; and JP-A-2-153348 discloses N-methylol compounds of pyrrole, pyrrolidine, methylamine, glycine, or ethylcarbamate. Further, the methods for using these compounds have also been proposed in, for example, U.S. Pat. No. 4,786,583, 4,859,574, and 4,921,779 and European Patents No. 345,172A and 395,442A.

However, of these compounds, those having the reduced vapor pressure of formaldehyde as compared with formaldehyde itself are poor in the image preservability, and those having the improved image preservability only have the same vapor pressure of formaldehyde as formaldehyde itself. These compounds can not have both the effect of improving the image preservability and the reduction of vapor pressure of formaldehyde.

Also, it has been found that these compounds cause the formation of stain, the deterioration of preservability of a yellow or cyan dye or other dyes contained in the light-sensitive material, and the reduction of solubility although the image preservability of a magenta dye is improved, and there is the problem that these compounds stick to the light-sensitive material and stain the processed image.

Therefore, there has been a strong demand for a compound having a sufficient anti-fading function to a magenta dye and the low formaldehyde vapor pressure, that is, for an effective alternative for formaldehyde.

SUMMARY OF THE INVENTION

One object of the present invention is to provide a color image-stabilization processing solution which does not substantially release the compounds harmful to the human body.

A second object of the present invention is to provide a color image-stabilization processing solution which can provide a color image which is safe and is excellent in the image preservability of a light-sensitive material after processing and a processing method using the same.

A third object of the present invention is to provide a color image-stabilization processing solution which can provide a color image having a superior image preservability and causes no problems such as stain of a light-sensitive material and a processing method using the same.

These and other objects of the present invention have been achieved by:

(1) a color image-stabilization processing solution for a silver halide color photographic material containing at least one of (a) an N-methylol compound represented by the following formula (I):

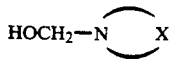

(I)

wherein X represents a group of non-metallic atoms necessary to form a 1H-pyrazole ring or 1H-1,2,4-triazole ring together with the nitrogen atom; and (b) an N-methylol compound satisfying the condition that an equilibrium constant in water at room temperature is $2\times10^{-2}$ mol/liter or less and a formaldehyde-releasing rate constant is ($1\times10^{-5}$ $sec^{-1}$ or more (hereinafter referred to as condition (A)), and (2) a method for processing an image-wise exposed silver halide color photographic material, which comprises processing the photographic material with a color image-stabilization processing solution and/or color image-stabilization processing replenishing solution containing at least one of the N-methylol compound of formula (I) and the compound satisfying condition (A).

DETAILED DESCRIPTION OF THE INVENTION

The color image-stabilization processing solution of the present invention containing the N-methylol compound of the present invention can provide a working environment in which formaldehyde vapor pressure is reduced. (The "N-methylol compound of the present invention" as used herein includes both the compound of formula (I) and the compound satisfying condition (A).) Further, the present invention is largely characterized by the fact that a dye image can be stabilized by processing a light-sensitive material with a color image-stabilization processing solution containing the N-methylol compound of the present invention without using formaldehyde. Accordingly, in the present invention, any processing step, processing method, processing solution and light-sensitive material can be used as long as the color image-stabilization processing solution of the present invention is used.

The N-methylol compounds represented by formula (I) will be explained in more detail.

The pyrazole ring or 1,2,4-triazole ring formed by X may be substituted or unsubstituted. Further, where the pyrazole ring formed by X has at least two or more substituents, the substituents which are in the ortho position to each other may combine with each other to form a 5- to 7-membered ring.

Of the N-methylol compounds represented by formula (I), preferred are the compounds satisfying condition (A).

Of the N-methylol compounds represented by formula (I), further preferred are the compounds represented by the following formula (Ia):

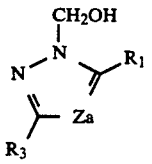

(Ia)

wherein Za represents —N=, —CH= or —C($R_2$)=; $R_1$, $R_2$ and $R_3$ may be the same or different, and each represents a hydrogen atom, an alkyl group, an alkenyl group, an aryl group, a heterocyclic group, a halogen atom, a nitro group, a cyano group, a sulfo group, a carboxyl group, a phospho group, an acyl group, a sulfonyl group, a sulfinyl group, an acyloxy group, an alkoxycarbonyl group, a carbamoyl group, a sulfamoyl group, an amino group, or —Y—Ra, in which Y represents an oxygen atom or a sulfur atom, and Ra represents an alkyl group, an alkenyl group, an aryl group or a heterocyclic group; the above groups may be further substituted with the above groups, a hydroxy group, etc.; and $R_1$ and $R_2$ or $R_2$ and $R_3$ may combine with each other to form a 5- to 7-membered ring.

More specifically, in formula (Ia) $R_1$, $R_2$ and $R_3$ each represents a hydrogen atom, an alkyl group (for example, methyl, ethyl, n-propyl, butyl, cyclopropyl, hydroxymethyl and methoxymethyl), an alkenyl group (for example, allyl), an aryl group (for example, phenyl and 4-tert-butylphenyl), a heterocyclic group (for example, 5-pyrazolyl and 4-pyrazolyl), a halogen atom (for example, chlorine, fluorine and bromine), a nitro group, a cyano group, a sulfo group, a carboxyl group, a phospho group, an acyl group (for example, acetyl, benzoyl and propanoyl), a sulfonyl group (for example, methanesulfonyl, octanesulfonyl and toluenesulfonyl), a sulfinyl group (for example, methanesulfinyl), an acyloxy group (for example, acetoxy), an alkoxycarbonyl group (for example, methoxycarbonyl and butoxycarbonyl), a carbamoyl group (for example, carbamoyl and N-ethylcarbamoyl), a sulfamoyl group (for example, sulfamoyl and N-ethylsulfamoyl), an amino group (for example, amino, diethylamino, acetylamino, methanesulfonamino, methylureido, N-methylsulfamoylamino, and methoxycarbonylamino), an alkoxy group (for example, methoxy and ethoxy), an alkylthio group (for example, methylthio and octylthio), an aryloxy group (for example, phenoxy), an arylthio group (for example, phenylthio), a heterocyclicoxy group (for example, 1-phenyltetrazole-5-oxy), and a heterocyclic thio group (for example, benzothiazolylthio).

In formula (Ia), preferred $R_1$, $R_2$ and $R_3$ are independently a hydrogen atom, an alkyl group, an alkenyl group, a halogen atom, a sulfo group, a carboxyl group, an acyloxy group, an amino group, an alkoxy group and an alkylthio group, and a hydrogen atom, an alkyl group, a halogen atom, an acyloxy group, an amino group, an alkoxy group and an alkylthio group are more preferred, and a hydrogen atom, an alkyl group, an amino group, an alkoxy group and an alkylthio group are most preferred.

From the viewpoint of the heat-fading property of a cyan image or the prevention of a yellow stain, preferred are the compounds in which $R_1$, $R_2$ and $R_3$ in formula (Ia) are independently a hydrogen atom or an unsubstituted alkyl group having 1 to 3 carbon atoms, more preferred are the compounds in which at most one of $R_1$, $R_2$ and $R_3$ is a methyl group and the others are the hydrogen atom, and particularly preferred are the compounds in which all of them are the hydrogen atoms.

The dissolution of the N-methylol compound of the present invention in water at room temperature (about 25° C.) causes the following reaction to reach an equilibrium:

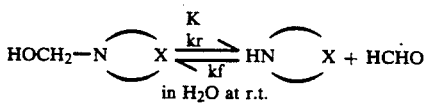

kr: a formaldehyde-releasing rate constant
kf: a generation speed of an N-methylol compound -continued K: an equilibrium constant defined by:

$$K: \frac{[HN \frown X]\,[HCHO]}{[HOCH_2-N \frown X]}$$

K in the above reaction shows the equilibrium constant defined by the present invention. Further, kr in the above reaction shows the formaldehyde-releasing rate constant defined by the present invention. In the present invention, "in water" includes heavy water in addition to the conventionally used water.

The equilibrium constant can be obtained by measuring the heavy water solution in which the N-methylol compound of the present invention is dissolved or the heavy water solution containing an amine compound and formaldehyde (37% formalin aqueous solution) in the equimolar amounts each other with a nuclear magnetic resonance absorption method (NMR) and calculating from a proton ratio at the moment the components generated in the solution when the peak variation of NMR was not observed.

The formaldehyde-releasing rate constant kr was obtained in the following manner: formaldehyde and an amine compound were added to water or heavy water at a room temperature and the amounts of the N-methylol compound, formaldehyde and amine compound were observed over time until they reached the equilibrium to obtain the generation speed constant kf of the N-methylol compound; and the constant kf thus obtained was multiplied by the above equilibrium constant K to calculate the formaldehyde-releasing rate constant kr. The compound can be detected by a nuclear magnetic resonance absorption method, an ultraviolet or visible radiation spectroscopic method, high performance liquid chromatography, or a calorimetric quantitative method, and the means for the detection can be appropriately selected depending on the degree of reaction rate.

Further, the equilibrium constant K is $2\times10^{-2}$ mol/liter or less, preferably $1.5\times10^{-2}$ mol/liter or less, and more preferably $1\times10^{-2}$ mol/liter or less. The formaldehyde-releasing rate constant kr is $1\times10^{-5}$ $sec^{-1}$ or more, preferably $1\times10^{-4}$ $sec^{-1}$ or more, further more preferably $1\times10^{-3}$ $sec^{-1}$ or more and most preferably $1\times10^{-2}$ $sec^{-1}$ or more.

The N-methylol compound satisfying condition (A) of the present invention includes, for example, an N-methylol product of pyrazole, an N-methylol product of 1,2,4-triazole, and an N-methylol product of urazole.

The compound satisfying condition (A) of the present invention preferably has a cyclic nitrogen-containing heterocyclic amine compound as structure of the amine compound to be released and the cyclic nitrogen-containing heterocyclic amine compound preferably has an aromatic ring or keto or ketoid structure of an aromatic ring.

Of the compounds satisfying condition (A) of the present invention, further preferred are the compounds represented by the following formula (III):

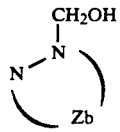

(III)

wherein Zb represents a group of non-metallic atoms necessary to form a 4- to 8-membered ring, provided that the atom to be bonded to the nitrogen atom is an atom selected from a carbon atom, an oxygen atom or a sulfur atom.

The ring formed by Zb may have a substituent. Further, the ring formed by Zb may be condensed by an aromatic ring, an aliphatic ring or a hetero ring or may be a spiro ring. The substituents that the ring formed by Zb may have include those of $R_1$ in formula (Ia). Of these, compounds which are not condensed by a benzene ring are preferred as the compounds represented by formula (III), because the compounds which are condensed by a benzene ring have a low solubility.

In the N-methylol compounds satisfying condition (A) of the present invention, more preferred are the N-methylol compounds represented by formula (I) above, further more preferred are the N-methylol compounds represented by formula (Ia) above, and most preferred are the 1H-1,2,4-triazole-1-methanol compounds (i.e., Za of formula (Ia) is a nitrogen atom).

Preferred in the present invention are the N-methylol compounds having a pKa of an amine compound which is formed together with formaldehyde when dissolved in water being 8 or less, preferably 7 or less, more preferably 6 or less in water at a room temperature. The lower limit is 0.01 or more, preferably 0.1 or more, more preferably 0.5 or more, and most preferably 1 or more.

The N-methylol compound of the present invention is a water-soluble N-methylol compound, and has a total number of carbon atoms of preferably 15 or less, more preferably 12 or less, further more preferably 10 or less, and most preferably 6 or less.

Examples of the N-methylol compounds of the present invention are shown below, but are not limited thereto:

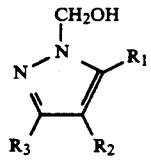

| Compound | $R_1$ | $R_2$ | $R_3$ |
|---|---|---|---|
| (I-1) | H | H | H |
| (I-2) | $CH_3$ | H | H |
| (I-3) | H | $CH_3$ | H |
| (I-4) | H | H | $CH_3$ |
| (I-5) | $CH_3$ | H | $CH_3$ |
| (I-6) | H | H | $C_2H_5$ |
| (I-7) | H | H | $CH_2OH$ |
| (I-8) | H | H | $CH_2OCH_3$ |
| (I-9) | H | H | $C_3H_5$(n) |
| (I-10) | H | H | 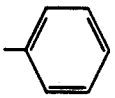 |

-continued
| | | | |
|---|---|---|---|
| (I-11) | H | H | 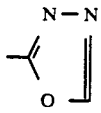 |
| (I-12) | H | $C_2H_5$ | H |
| (I-13) | H | $CH_2OH$ | H |
| (I-14) | $CH_3$ | $CH_3$ | $CH_3$ |
| (I-15) | $CH_2OH$ | H | $CH_3$ |
| (I-16) | $CH_3$ | H | 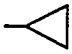 |
| (I-17) | | $-(CH_2)_4-$ | $CH_2OH$ |
| (I-18) | H | H | 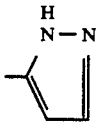 |
| (I-19) | H | 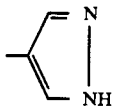 | H |
| (I-20) | H | H | $CO_2CH_3$ |
| (I-21) | $CH_3$ | Cl | $CH_3$ |
| (I-22) | H | $NO_2$ | H |
| (I-23) | H | H | $COCH_3$ |
| (I-24) | $OCH_3$ | H | $CH_3$ |
| (I-25) | $-CH=CH-CH=CH-$ | | H |
| (I-26) | H | Cl | H |
| (I-27) | H | $CO_2C_2H_5$ | H |
| (I-28) | H | CN | H |
| (I-29) | $CH_3$ | H | $NHCOCH_3$ |
| (I-30) | H | $NHCONHCH_2CH_2OH$ | H |
| (I-31) | H | H | $NHCO_2CH_3$ |
| (I-32) | H | H | $NHSO_2CH_3$ |
II-1
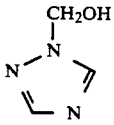
II-2
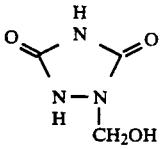
II-3
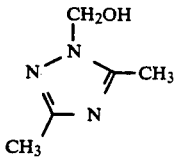
II-4
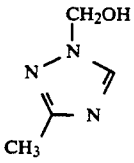
-continued
II-5
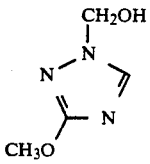
II-6
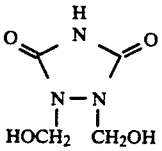
II-7
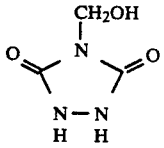
II-8
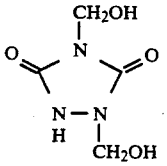
II-9
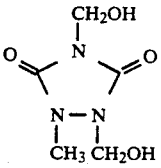
II-10
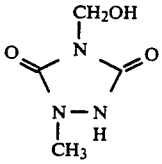
II-11
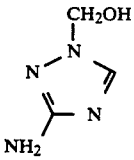
II-12
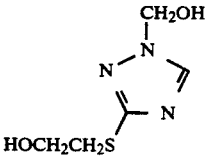
II-13
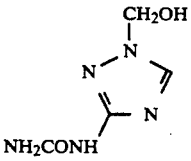

-continued

II-14

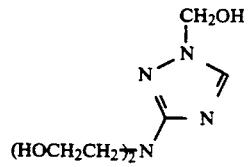

II-15

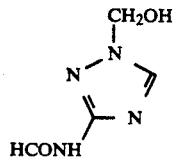

II-16

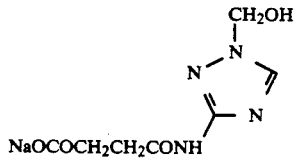

II-17

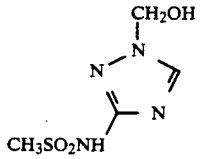

II-18

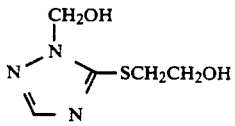

II-19

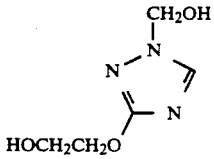

II-20

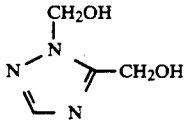

II-21

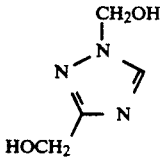

II-22

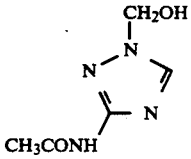

II-23

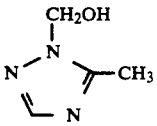

-continued

II-24

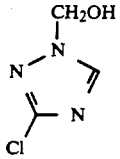

II-25

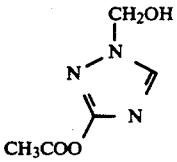

II-26

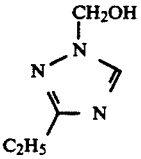

The N-methylol compounds of the present invention can be readily synthesized by reacting an amine compound such as pyrazole, 1,2,4-triazole or the derivative thereof with formaldehyde or praraformaldehyde. These syntheses can be carried out according to the methods described in U.S. Pat. No. 2,883,392, *Chem. Ber.*, 85, 820 ('52), *J. Org. Chem.*, 15,1285 ('50), European Patent No. 60,222A, and *Khim. Geterotsikl. Soedin.*, (2), 251 ('80)[Chemical Abstracts, 93: 46530W]. Meanwhile, the pyrazole derivative can be synthesized by the methods described in R. H. Wiley "Pyrazoles, pyrazolines, Pyrazolidines, Indoles and Condensed Ring" in The Chemistry of Heterocyclic Compounds, Vol. 22, published by Interscience Publishers (,67), or by the methods corresponding thereto.

Syntheses examples of the N-methylol compounds of the present invention are shown below.

Synthesis 1—Compound (I-1)

Pyrazole (68.1 g), sodium hydrozide (0.14 g) and methanol (80 ml) were put in a 500 ml three-neck flask equipped with a stirrer, a thermometer and a condenser. After the temperature was raised to 50° C., 90% paraformaldehyde (33 g) was added little by little and the stirring was applied at the same temperature for one hour. After reaction had finished, the solution was filtered and the filtrate was concentrated at a reduced pressure at 40° C. or lower. Ethyl acetate (300 ml) was added to the concentrate thus obtained for crystallization, whereby Compound (I-1) of colorless crystal was obtained. (Yield: 72 g, melting point: 79° to 84° C.). The chemical structure thereof was confirmed with an elementary analysis and various spectra.

The equilibrium constant K of this compound was $5.6\times10^{-3}$ mole/liter, wherein the equilibrium constant was obtained by measuring the heavy water solution of 25 millimole/liter of this compound with a nuclear magnetic resonance absorption method (NMR) and calculating from a portion ratio at the moment the components generated in the solution when the peak variation of NMR was not observed.

Further, the formaldehyde-releasing rate constant kr was $8.7\times10^{-2}$ sec$^{-1}$, wherein the constant kr was obtained in the following manner: formaldehyde and pyrazole were added to water at a room temperature and the amounts of this compound, formaldehyde and pyrazole were observed over time until they reached the equilibrium to obtain the generation speed constant kf of this compound; and the constant kf thus obtained was multiplied by the above equilibrium constant K to calculate the formaldehyde-releasing rate constant kr. This compound was detected by an ultraviolet spectroscopic method.

The pKa value of pyrazole generated by releasing from this compound was 2.5 in water at a room temperature.

Synthesis 2—Compound (I-5)

3,5-dimethylpyrazole (48.1 g), sodium hydroxide (0.07 g) and methanol (50 ml) were put in a 300 ml three-necks flask equipped with a stirrer, a thermometer and a condenser. After the temperature was raised to 50° C., 90% paraformaldehyde (16.5 g) was added little by little and stirring was applied at the same temperature for one hour. After the reaction finished, the solution was filtered and the filtrate was concentrated at a reduced pressure at 40° C. or lower. Ethyl acetate (150 ml) was added to the concentrate thus obtained for crystallization, whereby Compound (I-5) of a colorless crystal was obtained. (Yield: 28g, melting point: 108° to 111° C.). The chemical structure thereof was confirmed with an elementary analysis and various spectra.

The equilibrium constant K of this compound was $3.3\times10^{-3}$ mole/liter and the pKa of 3,5-dimethylpyrazole generated by releasing from this compound was 4.1 in water at a room temperature.

The equilibrium constants, K of typical N-methylol compounds of the present invention which are obtained according to the method of compound (I-1) and the comparative compounds are shown in Table 3 below.

TABLE 3

| Compound No. | Equilibrium Constant, K (mol/liter) | Remarks |
|---|---|---|
| I-1 | $5.6\times10^{-3}$ | Invention |
| I-2 | $3.0\times10^{-3}$ | Invention |
| I-3 | $2.7\times10^{-3}$ | Invention |
| I-4 | $3.0\times10^{-3}$ | Invention |
| I-6 | $3.3\times10^{-3}$ | Invention |
| I-26 | $4.7\times10^{-3}$ | Invention |
| I-27 | $7.5\times10^{-3}$ | Invention |
| I-28 | $1.45\times10^{-2}$ | Invention |
| I-29 | $6.5\times10^{-3}$ | Invention |
| II-1 | $1.2\times10^{-2}$ | Invention |
| II-2 | $1.4\times10^{-3}$ or less | Invention |
| II-3 | $1.1\times10^{-2}$ | Invention |
| Comp. Compound (a) | $1.3\times10^{-3}$ | Comparison |
| Comp. Compound (b) | $3.9\times10^{-3}$ | Comparison |
| Comp. Compound (c) | $1.2\times10^{-1}$ | Comparison |
| Comp. Compound (d) | $3.0\times10^{-2}$ | Comparison |
| Comp. Compound (e) | $3.6\times10^{-1}$ | Comparison |
| Comp. Compound (f) | $3.0\times10^{-2}$ | Comparison |
| Comp. Compound (g) | $9.3\times10^{-2}$ | Comparison |
| Comp. Compound (h) | $2.8\times10^{-2}$ | Comparison |

In Table 3, the comparative compounds (a) to (h) are shown below.

Comparative Compound (a)

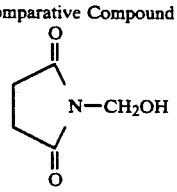

-continued

Comparative Compound (b)

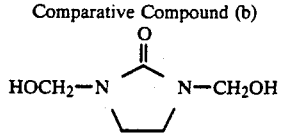

Comparative Compound (c)

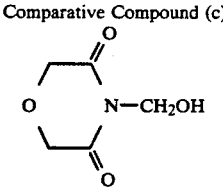

Comparative Compound (d)

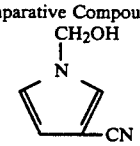

Comparative Compound (e)

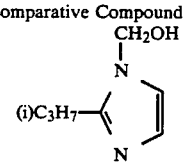

Comparative Compound (f)

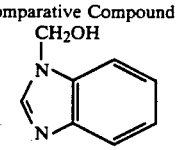

Comparative Compound (g)

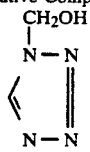

Comparative Compound (h)

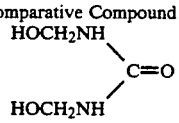

Further, of the compounds shown in Table 3, the formaldehyde-releasing rate constants, kr of the compounds (I-1), (II-2) and (II-3) and the comparative compounds (a), (b), (f) and (h) are shown in Table 4 below.

TABLE 4

| Compound No. | Formaldehyde-releasing rate constant, kr ($sec^{-1}$) | Remarks |
|---|---|---|
| I-1 | $8.7\times10^{-2}$ | Invention |
| II-2 | $2.0\times10^{-4}$ | Invention |
| II-3 | $1.4\times10^{-1}$ | Invention |
| Comp. Compound (a) | $4.5\times10^{-6}$ | Comparison |
| Comp. Compound (b) | $8.0\times10^{-6}$ | Comparison |
| Comp. Compound (f) | $9.9\times10^{-2}$ | Comparison |
| Comp. Compound (h) | $2.5\times10^{-6}$ | Comparison |

As is apparent from Table 3 and Table 4, the equilibrium constants of N-methylol products of pyrrole, imidazole or tetrazole compounds are more than $2\times10^{-2}$ mol/liter and are out of the specific value of the present invention. Further, the equilibrium constants of N-methylol products of alicyclic amide compound or urea compound satisfy the specific value of the present invention, but the formaldehyde-releasing rate constants are small and are out of the specific-value of the present invention.

The isolated N-methylol compounds of the present invention may be used as shown in the above synthetic examples, or the solution containing the N-methylol compounds of the present invention may be used as it is without isolating them in the above synthetic examples, wherein the solution is prepared by adding each equimolar amount of formaldehyde or paraformaldehyde and an amine compound such as pyrazole, 1,2,4-triazole, or the derivative thereof. Further, the N-methylol compound of the present invention may be contained in a processing bath, wherein formaldehyde or paraformaldehyde and an amine compound such as pyrazole, 1,2,4-triazole, or the derivative thereof are added to the processing bath to prepare the compound therein.

In the present invention, the color image-stabilization processing solution is defined as a solution having the effect of stabilizing the color image formed by a color development (particularly, the effect of preventing a fading of a magenta dye in storage), including their replenishing solutions. Accordingly, there are included therein the processing solutions used after the color development including their replenishing solutions. To be concrete, the processing solutions of the present invention include a stabilizing solution, a conditioning solution, a bleaching solution, a bleach-fixing solution and a stopping solution including the respective replenishing solutions. Preferably, the present invention is a stabilizing solution, a conditioning solution and a bleaching solution including their respective replenishing solutions, and particularly preferably a stabilizing solution including the replenishing solution thereof. In the present invention, a replenishing solution for a processing solution is defined as the solution which is used to replenish the components of the processing solution in a continuous processing.

The preferred embodiments are listed below:

(1) a stabilizing solution containing at least one N-methylol compound of the present invention,
(2) a stabilizing replenishing solution containing at least one N-methylol compound of the present invention,
(3) a conditioning solution containing at least one N-methylol compound of the present invention,
(4) a bleaching solution containing at least one N-methylol compound of the present invention,
(5) a method for processing with a stabilizing solution containing at least one N-methylol compound of the present invention,
(6) a method for processing while replenishing with a replenishing stabilizing solution containing at least one N-methylol compound of the present invention,
(7) a method for processing with a conditioning solution containing at least one N-methylol compound of the present invention, and
(8) a method for processing with a bleaching solution containing at least one N-methylol compound of the present invention.

Of these preferred embodiments, (1), (2), (5) and (6) are particularly preferred.

In the present invention, the stabilizing solution is defined as a stabilizing solution or washing-alternative stabilizing solution conventionally used at the final processing step of a color negative film and a color reversal film. When the final step comprises a washing step and a rinsing step, the stabilizing solution used at a stabilizing step prior thereto is included therein. It is used preferably at the final step.

The stabilizing solution and stabilizing replenishing solution conventionally used at the final step are the solutions containing formaldehyde as mentioned above and this formaldehyde has the effect of stabilizing an image.

In the present invention, formaldehyde is replaced with the N-methylol compound of the present invention to control the vapor pressure of formaldehyde at a lower level and stabilize the image. Accordingly, the color image-stabilization processing solution contains substantially no formaldehyde, wherein "contains substantially no formaldehyde" means that formaldehyde may be contained to such extent that the effects of the present invention can be attained. To be concrete, it means that the total content of formaldehyde and the hydrate thereof is 0.005 mole/liter or less. The lower the total content of formaldehyde and the hydrate thereof, the more preferable to lower the vapor pressure of formaldehyde, and it is particularly preferably 0.003 mole/liter or less.

The replenishing solutions for the respective processing solutions used in the present invention have the function of maintaining the properties of the processing solutions at the prescribed levels by replenishing the components which have decreased due to deterioration while processing and storing in an automatic processing machine and by conditioning the concentrations of the components eluted from the light-sensitive material in processing. Accordingly, the concentrations of the consumed components are higher in the replenishing solution than in the processing solution and those of the latter light-sensitive material components are lower in the replenishing solution than in the processing solution. The components which are less susceptible to variation of the concentration by processing and storing are contained usually in almost the same concentrations as those of the processing solutions.

The addition of the N-methylol compound of the present invention is preferably 0.003 to 0.1 mole, more preferably 0.005 to 0.03 mole per liter of the color image-stabilization processing solution.

The color image-stabilization processing solution to which the N-methylol compound of the present invention can be added and the other processing solutions which are used in the processing with the color image-stabilization processing solution of the present invention are described below. When the N-mehtylol compound of the present invention is used in processing solutions other than the stabilizing solution, the stabilizing solution may not contain the N-methylol compound of the present invention. In that case, the naming of the stabilizing solution is inappropriate because the processing solution itself no longer has the effect of stabilizing the color image, but hereafter it will be called that for convenience. Further, when the N-methylol compound of the present invention is added to a bleaching solution, a conditioning solution, etc., the naming of the bleaching solution, the conditioning solution, etc., are also inappropriate because these solutions have the stabilizing effect, but hereafter they will be called those respectively for convenience.

Described below are the stabilizing solution preferably containing the N-methylol compound of the present invention and the conditioning solution, which are used at the final step. The conditioning solution is processing solution which may be called the bleach-accelerating solution.

The stabilizing solution used at the final step can contain all compounds which can be added to washing water mentioned later. In particular, preferably contained therein are various surfactants for preventing irregularity by waterdrop in drying a light-sensitive material, various bactericides, anti-mold agents, fungicides and chelating agents for preventing generation of fur and mold grown on the light-sensitive material after processing. Further, there may be added an amine compound such as pyrazole, 1,2,4-triazole or the derivative thereof which contains no methylol group.

Also, in addition to the N-methylol compound of the present invention, the stabilizing solution may contain the compounds for stabilizing a dye image, for example, hexamethylenetetramine, a hexamethylenetetramine derivative, hexahydrotriazine, a hexahydrotriazine derivative, dimethylol urea, an organic acid, and a pH buffer agent. In addition to the above compounds, there can be used ammonium compounds such as ammonium chloride and ammonium sulfite, metal compounds containing Bi and Al, a fluorescent whitening agent, a hardener, and alkanol-amines described in U.S. Pat. No. 4,786,583.

The stabilizing solution used at the final step is used usually at pH ranging from 4 to 9, preferably 6 to 8.

Where the stabilizing solution of the present invention is used at the final step, the replenishing amount thereof is preferably 200 to 1500 ml, more preferably 300 to 600 ml, per $m^2$ of the light-sensitive material.

Where the stabilizing solution of the present invention is used at the final step, the processing temperature is preferably 30° to 45° C.; the processing time is preferably 10 seconds to 2 minute, particularly 15 to 30 seconds.

In addition to the N-methylol compound of the present invention, there can be incorporated into the conditioning bath, aminocarboxylic acid chelating agents such as ethylenediaminetetraacetic acid, diethylentriaminepentaacetic acid, 1,3-diaminopropanetetraacetic acid, and cyclohexanediaminetetraacetic acid; and various bleach-accelerating agents including sulfites such as sodium sulfite and ammonium sulfite, thioglycerine, aminoethanethiol, and sulfoethanethiol.

Further, for the purpose of preventing scums there are preferably incorporated therein sorbitan esters of fatty acids substituted with ethylene oxide, described in U.S. Pat. No. 4,839,262, and polyoxyethylene compounds described in U.S. Pat. No. 4,059,446 and Research Disclosure, vol.191, 19104 (1980).

These compounds can be used in the range of 0.1 to 20 g, preferably 1 to 5 g, per liter of the conditioning solution.

The pH value of the conditioning solution is usually 3 to 11, preferably 4 to 9, and more preferably 4.5 to 7.

The processing time in the conditioning solution is 30 seconds to 5 minutes.

The replenishing amount for the conditioning solution is preferably 30 to 3000 ml, particularly preferably 50 to 1500 ml, per $m^2$ of a light-sensitive material.

The processing temperature of the conditioning solution is preferably 20° to 50° C., particularly preferably 30° to 40° C.

Usually, after being subjected it to an imagewise exposure, a silver halide color photographic light-sensitive material is subjected to a color development in the case of negative type and positive type light-sensitive materials, and to a color development following a black/white development and a reversal processing in the case of a reversal positive type light-sensitive material.

The color developing solution which can be used in the present invention is an alkaline aqueous solution containing an aromatic primary amine color developing agent as the main component.

The preferred color developing agent is a p-phenylenediamine derivative. Representative examples thereof are shown below, but are not limited thereto:

D-1 N,N-diethyl-p-phenylenediamine;

D-2 2-Methyl-N,N-diethyl-p-phenylenediamine;

D-3 4-[N-ethyl-N-(β-hydroxyethyl) amino] aniline;

D-4 2-Methyl-4-[N-ethyl-N-(β-hydroxyethyl) amino] aniline;

D-5 4-Amino-3-methyl-N-[β-(methanesulfonamide) ethyl aniline;

D-6 4-Amino-3-methyl-N-ethyl-N-methoxyethylaniline; and

D-7 4-Amino-3-methyl-N-ethyl-N-(4-hydroxybutyl) aniline.

Among the above p-phenylenediamine derivatives, D-4 and D-5 are preferred.

These p-phenylenediamine derivatives may be sulfates, chlorates, sulfites and p-toluenesulfonates thereof.

The aromatic primary amine color developing agent is used preferably in a concentration of 0.001 to 0.1 mole, more preferably 0.01 to 0.06 mole, per liter of the color developing solution.

There can be added as a preservative to the color developing solution, sodium sulfite, potassium sulfite, sodium bisulfite, potassium bisulfite, sodium metasulfite, potassium metasulfite, and a carbonyl sulphurous acid adduct, according to necessity.

The addition amount of these preservatives is preferably 0.5 to 10 g, more preferably 1 to 5 g, per liter of the color developing solution.

Examples of the compounds for preserving directly the above aromatic primary amine color developing agent include the various hydroxylamines described in JP-A-63-5341 and JP-A-63-106655 (above all, preferred are the compounds having a sulfo group and a carboxy group); the hydroxamic acids described in JP-A-63-43138; the hydrazines and hydrazides described in JP-A63-146041; the phenols described in JP-A-63-44657 and JP-A-63-58443; the α-hydroxy ketones and α-aminoketones described in JP-A-63-44656; and the various kinds of sucrose described in JP-A-63-36244.

Also, there can be used in combination with the above compounds: monoamines described in JP-A-63-4235, JP-A-63-24254, JP-A-63-21647, JP-A-63-146040, JP-A-63-27841, and JP-A63-25654; diamines described in JP-A-63-30845, JP-A-63-14640, and JP-A-63-43139; polyamines described in JP-A-63-21647, JP-A-63-26655, and JP-A-63-44655; nitroxy radicals described in JP-A-63-53551; alcohols described in JP-A-63-43140 and JP-53549; oximes described in JP-A-63-56654;and tertiary amines described in JP-A-63-239447.

There may be contained according to necessity the other preservatives such as the various metals described in JP-A-57-44148 and JP-A-57-53749; the salicylic acids described in JP-A-59-180588; the alkanolamines described in JP-A-54-3582; the polyethyleneimines described in JP-A-56-94349; and the aromatic polyhydroxy compounds described in U.S. Pat. No. 3,746,544. Among them, the aromatic polyhydroxy compounds are particularly preferable.

The color developing solution preferably has pH of 9 to 12, more preferably 9 to 11.0.

In order to maintain a pH at the above level, various buffer agents are preferably used.

Examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate, potassium o-hydroxybenzoate, sodium 5-sulfo-2-hydroxybenzoate (sodium 5- sulfosalicylate), and potassium 5-sulfo-2-hydroxybenzoate (potassium 5-sulfo-salicylate). The addition amount of the buffer agent is preferably 0.1 mole or more, more preferably 0.1 to 0.4 mole, per liter of the color developing solution.

In addition to the above compounds, various chelating agents are preferably used as an anti-precipitation agent for calcium and magnesium or for the purpose of improving the stability of the color developing solution. Organic acid compounds are preferred as the chelating agent and examples thereof include amino-polycarboxylic acids, organic phosphonic acids and phosphonocarboxylic acids.

Representative examples thereof are diethylenetriaminepentaacetic acid, ethylenediaminetetraacetic acid, N,N,N-trimethylenephosphonic acid, ethylenediamine N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine-orthohydroxyphenylacetic acid, phosphonobutane-1,2,4-tricaboxylic acid, 1-hydroxyethylidene-1,1-diphosphonic acid, and N,N'-bis(2-hydroxybenzyl) ethylenediamine-N,N'-diacetic acid.

These chelating agents may be used in combination of two or more, according to necessity.

The addition amount of the chelating agent may be an amount sufficient to capture metal ions and is at a level, for example, of 0.1 to 10 g per liter of the color developing solution.

Arbitrary development accelerators can be added to the color developing solution according to necessity. However, the color developing solution used in the present invention preferably contains substantially no benzyl alcohol from the viewpoint of a public pollution, the preparing property of the solution and the prevention of a color stain. The term "substantially no benzyl alcohol" means that it is contained in the amount of 2 ml or less per liter of the color developing solution and preferably it is not contained at all.

There can be added as the other development accelerators, the thioether compounds described in JP-B-37-16088 (the term "JP-B" as used herein means an examined Japanese patent publication), JP-B-37-5987, JP-B-38-7826, JP-B-44-12380, and JP-B-45-9019, and U.S. Pat. No. 3,818,247; the phenylenediamine compounds described in JP-A-52-49829 and JP-A-50-15554; the quaternary ammonium salts described in JP-A-50-137726, JP-B-44-30074, JP-A-56-156826 and JP-A-52-43429; the amine compounds described in U.S. Pat. Nos. 2,494,903, 3,128,182, 4,230,796, 3,253,919, 2,482,546, 2,596,926, and 3,582,346, and JP-B-41-11431; the polyalkylene oxide described in JP-B-37-16088, JP-B-42-25201, JP-B-41-11431 and JP-B-42-23883, and U.S. Pat. Nos. 3,128,183 and 3,532,501; 1-phenyl-3-pyrazolidones; and imidazoles. They can be added according to necessity.

The addition amount of the development accelerator is 0.01 to 5 g per liter of the color developing solution.

In the present invention, an arbitrary anti-foggant can further be added according to necessity.

There can be used as the anti-foggant, an alkali metal halide such as sodium chloride, potassium bromide and potassium iodide, and an organic anti-foggant. Typical examples of the organic anti-foggant are the nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine, and adenine. The addition amount of the anti-foggant is 0.01 to 1 g per liter of the color developing solution.

The color developing solution used in the present invention may contain a fluorescent whitening agent. The 4,4'-diamine-2,2,-disulfostilbene compounds are preferred as the fluorescent whitening agent. The addition amount thereof is 0 to 5 g, preferably 0.1 to 4 g, per liter of the color developing solution.

Also, there may be added various surfactants such as alkylsulfonic acid, arylsulfonic acid, aliphatic carboxylic acid, and aromatic carboxylic acid.

A color developing-replenishing solution contains the compounds contained in the color developing solution. The functions of the color developing-replenishing solution are (i) to replenish to the color developing solution, the compounds which are consumed due to processing of a light-sensitive material and deterioration caused during the storage in an automatic developing machine and (ii) to maintain the developing properties at the fixed levels by conditioning the concentrations of the compounds eluted from the light-sensitive material by processing. Accordingly, the concentrations of the former are maintained higher than those of the color developing tank solution, and those of the latter are lower. Examples of the former compounds are the color developing agent and preservative, which are contained in amounts 1.1 to 2 times as large as those of the tank solution in the replenishing solution. An example of the latter compound is a development inhibitor represented by halide (for example, potassium bromide), and it is contained in the replenishing solution in the amount 0 to 0.6 times that of the tank solution.

The concentration of the halides in the replenishing solution is usually 0.006 mole/liter or less and has to be decreased more in a lower replenishing, or it may not be contained at all.

The compounds which are less susceptible to concentration variation resulting from processing and storing are contained in the same concentrations as those of the color developing tank solutions. The examples thereof are the chelating agent and the buffer agent.

Further, the pH of the color developing-replenishing solution is maintained higher by 0.05 to 0.5 than that of the tank solution. This difference of pH has to be increased according to the decrease in the replenishing amount.

The color developing solution is replenished in the amount of 3000 m or less, preferably 100 to 1500 ml, per $m^2$ of the light-sensitive material.

The processing temperature in the color developing solution is suitably 20° to 50° C., preferably 30° to 45° C. The processing time is suitably 20 seconds to 5 minutes, preferably 30 seconds to 3 minutes and 20 seconds, and more preferably 1 minute to 2 minutes and 30 seconds.

Also, a color developing bath may be divided into two or more baths according to the need to replenish the color developing-replenishing solution from the front or rear bath thereby to shorten the processing time and reduce the replenishing amount.

The processing method of the present invention can be preferably applied to color reversal processing. Reversal processing is carried out according necessity and then the color development is performed. A black/white developing solution used for the above processing is a so-called first black/white developing solution used for reversal processing of a conventional color light-sensitive material. It can contain various well-known additives which are added to a black/white developing solution used for processing a black/white silver halide light-sensitive material.

Representative additives include developing agents such as 1-phenyl-3-pyazolidone, Metol and hydroquinone, a preservative such as sulfite, an accelerator consisting of an alkali such as sodium hydroxide, sodium carbonate and potassium carbonate, an inorganic or organic inhibitor such as potassium bromide, 2-methylbenzimidazole and methylbenzthiazole, a hard water softener such as polyphosphoric acid, and a development inhibitor consisting of a trace amount of iodide and a mercapto compound.

When processing is carried out with the above black/white developing solution or color developing solution in an automatic developing machine, the area (opening area) in which the developing solution (the color developing solution and black/white developing solution) contacts air is preferably as small as possible. For example, the opening ratio is preferably 0.01 $cm^{-}$or less, more preferably 0.005 $cm^{-1}$ or less, wherein the opening ratio is obtained by dividing an opening area ($cm^2$) by the volume ($cm^3$) of the developing solution.

The developing solution can be regenerated for reuse. The regeneration of the developing solution means that the used developing solution is subjected to treatment with an anionic exchange resin and an electro-dialysis, or the processing chemicals called as the regenerating agents are added to the used developing solution, to increase the activity of the developing solution and use it once again as the processing solution.

A regeneration rate (the rate of an overflow solution in a replenishing solution) is preferably 50% or more, particularly 70% or more.

In the processing in which the regeneration of the developing solution is used, the overflow solution is used as the replenishing solution after regenerating.

In a regeneration method, an anionic exchange resin is preferably used. The particularly preferred composition of the anionic exchange resins and the regeneration method of the resins are described in *Diaion Manual* (I) (14th edition, 1986) published by Mitsubishi Chemical Industry Co., Ltd. Of the anionic exchange resin reins, the resins of the composition described in JP-A-2-952 and JP-A-1-281152 are preferred.

In the present invention, the light-sensitive material after being subjected to color development is subjected to a desilvering processing. The desilvering processing as described herein consists basically of a bleaching processing and a fixing processing. Usually, it consists of a bleach-fixing processing in which both are simultaneously carried out, and the combination of these processings.

The representative desilvering processing steps are shown below:

1. Bleaching—fixing
2. Bleaching—bleach-fixing
3. Bleaching—washing—fixing
4. Bleaching—bleach-fixing—fixing
5. Bleach-fixing
6. Fixing—bleach-fixing Of the above steps, the steps 1, 2, 4 and 5 are particularly preferred. The step 2 is disclosed in, for example, JP-A-61-75352. The step 4 is disclosed in JP-A-61-143755 and Japanese Patent Application No. 2-216389.

The baths such as the bleaching bath and fixing bath applied to the above steps may be a one bath structure or a two or more bath structure (for example, 2 to 4 baths, wherein a counter-current replenishing system is preferable).

The above desilvering processing step may be carried out following a rinsing, washing and stopping after color developing. In the processing of a negative light-sensitive material, it is preferably carried out immediately after color developing, and in a reversal processing it is preferably carried out following a conditioning bath after color developing.

The bleaching solution can contain an N-methylol compound of the present invention. There can be mentioned as the bleaching agent contained as the main component for the bleaching solution of the present invention, inorganic compounds such as red prussiate, ferric chloride, bichromates, persulfates, and bromates, and semi-organic compounds such as an aminopolycarboxylic acid ferric complex salt and an aminopolyphosphonic acid ferric complex salt.

In the present invention, an aminopolycarboxylic acid ferric complex salt is preferably used from the viewpoint of environmental preservation, safety in handling and corrosion to metal.

Examples of the ferric complex salt of aminopolycarobxylic acid are shown below together with an oxidation/reduction potential, but these complexes are not limited thereto:

| | Compound No. | Potential* |
|---|---|---|
| 1. | Ferric complex salt of N-(2-acetamide) iminodiacetic acid | 180 |
| 2. | Ferric complex salt of methyliminodiacetic acid | 200 |
| 3. | Ferric complex salt of iminodiacetic acid | 210 |
| 4. | Ferric complex salt of 2,4-butylenediamine-tetraacetic acid | 230 |
| 5. | Ferric complex salt of diethylenethioether-diaminetetraacetic acid | 230 |
| 6. | Ferric complex salt of glycol ether diamine-tetraacetic acid | 240 |
| 7. | Ferric complex salt of 1,3-propylenediamine-tetraacetic acid | 250 |
| 8. | Ferric complex salt of ethylenediamine-tetraacetic acid | 110 |
| 9. | Ferric complex salt of diethylenetriamine-pentacetic acid | 80 |
| 10. | Ferric complex salt of trans-1,2-cyclohexane-diaminetetraacetic acid | 80 |

*Oxidation/reduction potential (mV vs. NHE, pH = 6)

The oxidation/reduction potential of the above bleaching agents is defined by the oxidation/reduction potential obtained by measuring with the method described in *Transactions of the Faraday Society*, vol. 55 (1959), pp. 1312 to 1313.

In the present invention, from the viewpoint of rapid processing nd effective demonstration of the effects of the present invention, the bleaching agent has preferably an oxidation/reduction potential of 150 mV or more, more preferably 180 mV or more, and most preferably 200 mV or more. The bleaching agent having too high an oxidation/reduction potential causes bleaching fog and therefore, the upper limit thereof is 700 mV or less, preferably 500 mV or less.

Of the above compounds, particularly preferred is Compound No. 7, the ferric complex salt of 1,3-propylenediaminetetraacetic acid.

The ferric complex salt of aminopolycarboxylic acid is used in the form of sodium, potassium and ammonium salts. Of them, the ammonium salt is preferred in terms of the most rapid bleaching speed.

The amount of the bleaching agent used in the bleaching solution is preferably 0.17 to 0.7 mole, more preferably 0.25 to 0.7 mole in terms of a rapid processing and reduction of stain by aging and particularly preferably 0.30 to 0.6 mole, per liter of the bleaching solution. Further, the amount of the bleaching agent used in the bleach-fixing solution is 0.01 to 0.5 mole, more preferably 0.02 to 0.2 mole, per liter of the bleach-fixing solution.

In the present invention, the bleaching agent may be used singly or in a combination of two or more. Where two or more bleaching agents are used, the total amount thereof may fall within the above range.

When the ferric complex salt of aminopoly-carboxylic acid is used in the bleaching solution, it can be added in the form of a complex salt as mentioned above, or aminopolycarboxylic acid which is a complex-forming compound and a ferric salt (for example, ferric sulfate, ferric chloride, ferric nitrate, ferric ammonium salfate and ferric phosphate) may coexist to form the complex salt thereof.

Where the complex salt is formed in the above manner, the aminopolycarboxylic acid may be added in a little more excessive amount than that necessary for forming the complex salt with a ferric ion, wherein it is used preferably in excess of 0.01 to 10%.

In general, the above bleaching solution is used at pH of 2 to 7.0. For rapid processing, the pH of the bleaching solution is preferably 2.5 to 5.0, more preferably 3.0 to 4.8, particularly preferably 3.5 to 4.5. That of the replenishing solution is 2.0 to 4.2.

In the present invention, conventional acids can be used to control pH in the above ranges. The acids used therefor have preferably pKa of 2 to 5.5, wherein pKa is defined by the cologarithm of a dissociation constant of acid and is the value obtained in the conditions of an ionic strength of 0.1 mole/dm and 25° C.

Acids having pKa ranging from 2.0 to 5.5 are preferably incorporated into the bleaching solution in an amount of 0.5 mole/liter or more since bleaching fog and precipitation in the replenishing solution in storing at a lower temperature occur.

The acids having pKa ranging from 2.0 to 5.5 may be inorganic acids such as phosphoric acid and organic acids such as acetic acid, malonic acid and citric acid. The acids showing the above improvement are the organic acids. Among such organic acids, particularly preferred are the organic acids having a carboxyl group.

The organic acids having pKa of 2.0 to 5.5 may be a monobasic acid or a polybasic acid. Where they are polybasic acids, they can be used in the form of metal salts (for example, sodium ad potassium salts) and ammonium salts as long as the pKa values thereof range from 2.0 to 5.5.

The organic acids having a pKa of 2.0 to 5.5 may be used in combination of two or more, provided that aminopolycarboxylic acid, the salt thereof and the Fe complex salt thereof are excluded from the acids as described herein.

The preferred examples of organic acids having a pKa of 2.0 to 5.5 are aliphatic monobasic acids such as acetic acid, monochloroacetic acid, monobromoacetic acid, glycolic acid, propionic acid, monocloropropionic acid, lactic acid, pyruvic acid, acrylic acid, butyric acid, isobutyric acid, pivaric acid, aminobutyric acid, valeric acid, and isovaleric acid; amino acid compounds such as asparagine, alanine, arginine, ethionine, glycine, glutamine, cysteine, serine, methionine, and leucine; aromatic monobasic acids such as benzoic acid, monosubstituted (for example, chloro and hydroxy) benzoic acid, and nicotinic acid; aliphatic dibasic acids such as oxalic acid, malonic acid, succinic acid, tartaric acid, malic acid, maleic acid, fumaric acid, oxaloacetic acid, glutaric acid, and adipic acid; dibasic amino acids such as aspartic acid, glutamic acid, and cystine; aromatic dibasic acids such as phthalic acids and terephthalic acid; and polybasic acids such as citric acid.

Among them, the monobasic acids having a hydroxyl group and a carboxyl group are preferred and particularly preferred are glycolic acid and lactic acid.

Glycolic acid and lactic acid are used in an amount of 0.2 to 2 mole, preferably 0.5 to 1.5 mole per liter of the bleaching solution. These acids are preferred since they can more notably demonstrate the effects of the present invention while they generate no odor and inhibit bleaching fog.

Also, the combined use of acetic acid and glycolic acid or lactic acid is preferred since it can markedly provide the effects of solving either of the problems of precipitation and bleaching fog. The molar ratio of acetic acid to glycolic acid or lactic acid used in combination is preferably 1:2 to 2:1.

The total amount of these acids used is suitably 0.5 mole or more, preferably 1.2 to 2.5 mole, and more preferably 1.5 to 2.0 mole, per liter of the bleaching solution.

When the pH of the bleaching solution is controlled in the above-described range, there may be used the above acids and alkali agents (for example, ammonia water, KOH, NaOH, imidazole, monoethanolamine, and diethanolamine). Among them, ammonia water is preferred.

Also, potassium carbonate, ammonia water, imidazole, monoethanolamine or diethanolamine is preferably used as an alkali agent for a bleaching starter used in preparing a starting solution of a bleaching solution from a replenishing solution. The diluted replenishing solution itself may be used without using the bleaching starter.

In the present invention, various bleaching accelerators can be added to the bleaching bath and the prebaths thereof. For example, there can be used the compounds having a mercapto group or a disulfide group, described in U.S. Pat. No. 3,893,858, German Patent No.

1,290,821, British Patent No. 1,138,842, JP-A-53-95630, and *Research Disclosure*, Vol. 17129 (July 1978); the thiazolidine derivatives described in JP-A-50-140129; the thio-urea derivatives described in U.S. Pat. No. 3,706,561; the iodides described in JP-A-58-16235; the polyethylene oxides described in German Patent 2,748,430; and the polyamine compounds described in JP-B-45-8836. Among the above compounds, particularly preferred are the mercapto compounds described in British Patent 1,138,842 and JP-A-2-190856.

The bleaching solution used in the present invention can contain the rehalogenization agents such as bromides (for example, potassium bromide, sodium bromide and ammonium bromide) and chlorides (for example, potassium chloride, sodium chloride and ammonium chloride). The concentration of the rehalogenization agent is 0.1 to 5.0 mole, preferably 0.5 to 3.0 mole, per liter of the processing solution.

Further, ammonium nitrate is preferably used as an anti-corrosion agent to protect metal.

In the present invention, a replenishing system is preferably applied. The bleaching solution is replenished preferably in amount of 600 ml or less, more preferably 100 to 500 ml, per $m^2$ of the light-sensitive material.

The bleaching time is 120 seconds or shorter, preferably 50 seconds or shorter and more preferably 40 seconds or shorter.

In processing, the bleaching solution containing the ferric complex salt of an aminopolycarboxylic acid is subjected to aeration to oxidize the formed ferric complex salt of aminopolycarboxylic acid, whereby the oxidizing agent is regenerated and the photographic properties are quite stably maintained.

In processing with the bleaching solution in the present invention, particularly the bleaching solution containing a high-potential bleaching agent, a so-called evaporation correction is preferably carried out, in which water corresponding to the evaporated processing solution is supplied.

The concrete methods of replenishing water in such a way are not specifically limited. Preferred among them are the methods described in JP-A-1-254959 and JP-A-1-254960, in which the amount of water evaporated from a monitoring bath settled separately from the bleaching bath is measured and the amount of water evaporated from the bleaching bath are calculated from the above amount of water to replenish the amount of water proportional thereto to the bleaching bath; and the evaporation-correction methods are described in Japanese Patent Application Nos. 2-46743, 2-47777, 2-47778, 2-47779, and 2-117972, in which a solution level sensor and an overflow sensor are used.

In the present invention, a light-sensitive material is processed with a processing solution having a fixing ability after processing with the bleaching solution. To be concrete, the processing solution having the fixing ability as described herein is a fixing solution and a bleach-fixing solution. Where the processing having a bleaching ability is carried out in the bleach-fixing solution, it may be combined with the processing having a fixing ability as shown in the above step 5. In the above steps 2 and 4 in which the processing with the bleach-fixing solution is carried out after the bleaching processing with the bleaching solution, the different bleaching agents may be contained in the bleaching solution and bleach-fixing solution, respectively. Where a washing step is interposed between the bleaching and fixing steps, the N-methylol compound of the present invention may be contained as well in the processing solutions used in those steps.

A fixing agent is contained in the processing solution having the fixing ability. The fixing agent may be thiosulfates such as sodium thiosulfate, ammonium thiosulfate, ammonium sodium thiosulfate, and potassium thiosulfate; thiocyanates (rhodanates) such as sodium thiocyanate, ammonium thiocyanate, and potassium thiocyanate; thioureas; and thioethers. Among them, ammonium thiosulfate is preferably used. The fixing agent is used in the amount of 0.3 to 3 mole, preferably 0.5 to 2 mole, per liter of the processing solution having the fixing ability.

Further, from the viewpoint of accelerating of the fixing, preferably used are above ammonium thiocyanate (ammonium rhodanate), thiourea and thioether (for example, 3,6-dithia-1,8-octanediol) in combination with thiosulfates. Of them, most preferably used are thiosulfate and thiocyanate in combination. The combined use of ammonium thiosulfate and ammonium thiocyanate is particularly preferred.

The amount of these compounds used in combination is 0.01 to 1 mole, preferably 0.1 to 0.5 mole per liter of the processing solution having fixing ability. On some occasions, the use of 1 to 3 mole can increase the fixing-acceleration effect to a large extent.

There can be incorporated into the processing solution having the fixing ability, preservatives such as sulfites (for example, sodium sulfite, potassium sulfite and ammonium sulfite), hydroxylamines, hydrazines, bisulfite adducts of aldehyde compounds (for example, acetaldehyde sodium bisulfite, particularly preferably the compounds described in Japanese Patent Application No. 1-298935), and the sulfinic acid compounds described in JP-A-1-231051.

Further, there can be incorporated therein various fluorescent whitening agents, defoaming agents, surfactants, polyvinylpyrrolidone, and organic solvents such as methanol.

The chelating agents such as aminopoly-carboxylic acids and organic phosphonic acids are preferably added to the processing solution having fixing ability. Preferred chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethyelentriaminepentaacetic acid, cyclohexanediaminetetraacetic acid, and 1,2-propylenediaminetetraacetic acid. Among them, particularly preferred are 1-hydroxyethylidene-1,1-diphosphonic acid and ethylenediaminetetraacetic acid.

The addition amount of the chelating agent is 0.01 to 0.3 mole, preferably 0.1 to 0.2 mole, per liter of the processing solution.

The fixing solution has preferably a pH of 5 to 9, more preferably 7 to 8. The bleach-fixing solution has preferably a pH of 4.0 to 7.0, more preferably 5.0 to 6.5. Further, the bleach-fixing solution after processing with a bleaching solution or a first bleach-fixing bath has preferably a pH of 6 to 8.5, more preferably 6.5 to 8.

The processing solution having fixing ability preferably contains a compound having pKa ranging from 6.0 to 9.0 for the purpose of conditioning the pH thereof in the above range and as a buffer agent. The preferred examples of such compounds are imidazoles such as imidazole and 2-methylimidazole. The additional amount of these compound is 0.1 to 10 mole, preferably 0.2 to 3 mole, per liter of the processing solution.

The bleach-fixing solution can contain the foregoing compounds which can be contained in the bleaching solution.

In the present invention, the bleach-fixing solution (a start solution) in starting the processing is prepared by dissolving the foregoing compounds used for the bleach-fixing solution in water. It may be prepared by mixing suitable amounts of a bleaching solution and a fixing solution, each prepared separately.

The replenishing amount of the fixing solution or bleach-fixing solution in applying a replenishing system is preferably 100 to 3000 ml, more preferably 300 to 1800 ml, per $m^2$ of the light-sensitive material.

The bleach-fixing replenishing solution itself may be replenished to the bleach-fixing solution, or the overflow solutions of the bleaching solution and the fixing solution may be used as the replenishing solution, as described in JP-A-61-43755 and Japanese Patent Application No. 2-216389.

Similar to the foregoing bleaching processing, bleach-fixing processing is preferably carried out while replenishing the water in an corresponding to the evaporated amount thereof, in addition to replenishing the processing solution.

In the present invention, the total processing time in the processing having a fixing ability is 0.5 to 4 minutes, preferably 0.5 to 2 minutes and particularly preferably 0.5 to 1 minute.

In the present invention, the total processing time in the desilvering processing comprising the combination of the bleaching, bleach-fixing and fixing steps is preferably 45 seconds to 4 minute, more preferably 1 to 2 minutes. The processing temperature is 25° to 50° C., preferably 35° to 45° C.

In the present invention, silver can be recovered from the used processing solution having fixing ability by conventional methods, and the regenerated solution after silver recovery can be reused. The effective silver recovering methods are an electrolysis method (described in French Paten 2,299,667), a setting method (described in JP-A-52-73037 and German Patent 2,331,220), an ion exchange resin method (described in JP-A-51-17114 and German Patent 2,548,237), and a metal substitution method (described in British Patent 1,353,805). These silver recovering methods are preferably carried out for the tank solutions in an inline system since the rapid processability can be further improved.

Usually, a washing processing step is performed after the processing step having the fixing ability.

There can be used a simple processing method in which a stabilizing processing is carried out with the stabilizing solution of the present invention without carrying out substantial washing after processing with the processing solution having fixing ability.

Washing water used in a washing step can contain various surfactants in order to prevent speckles by waterdrop on the light-sensitive material in drying after processing. The surfactant may be polyethylene glycol type nonionic surfactants, polyhydric alcohol type nonionic surfactants, alkylbenzenesulfonate type anionic surfactants, higher alcohol sulphuric ester salt type anionic surfactants, alkylnaphthalenesulfonate type anionic surfactants, quaternary ammonium salt type cationic surfactants, amine salt type cationic surfactants, amino salt type amphoteric surfactants, and betaine type amphoteric surfactants. Among them, the nonionic surfactants are preferably used. Particularly preferred are the alkylphenol-ethylene oxide adducts. Particularly preferred alkylphenols are octyl-, nonyl-, dodecyl- and dinonylphenols. The adduct molar number of ethylene oxide is particularly preferably 8 to 14. Further, silicone type surfactants having a higher defoaming effect are preferably used.

Various bactericides and fungicides may be added to the washing water in order to prevent the generation of fur and growth of mole on a light-sensitive material after processing. Examples of such bactericides and fungicides include thiazolylbenzimidazole type compounds described in JP-A-57-157244 and JP-A-58-105145; isothiazolone type compounds described in JP-A-57-8542; chlorophenol type compounds represented by trichlorophenol; bromophenol type compounds; organic tin and organic zinc compounds; acid amide compounds; diazine and triazine compounds; thiourea compounds; benzotriazole compounds; aklylguanidine compounds; quaternary ammonium compounds represented by benzoalcohonium chloride; antibiotics represented by penicillin; and conventional fungicides described in *J. Antibact. Antifunc. Agents*, Vol. 1, No. 5, pp. 207 to 223 (1983). They may be used in combination of two or more. Also, the various fungicides described in JP-A-48-83820 can be used.

Further, various chelating agents are preferably contained in the washing water. The preferred chelating agents include aminopolycarboxylic acids such as ethylenediaminetetraacetic acid and diethylenetriaminepentaacetic acid, organic phosphonic acids such as 1-hydroxyethylidene-1,1-diphosphonic acid, ethylenediaminetetraacetic acid and diethylenetriamine-N,N,N',N'-tetramethylenephosphonic acid, and the hydrolysis products of maleic anhydride polymer described in EP 345172 A1.

The preservatives which can be contained in the above fixing solution and bleach-fixing solution are preferably contained in the washing water.

The washing step and stabilizing step are preferably in a multi-stage counter current system. The number of stages is preferably 2 to 4. The replenishing amount thereof is 1 to 50 times the amount carried over from the preceding bath, preferably 2 to 30 times, and more preferably 2 to 15 times, per unit area.

Tap water can be used for the washing step. Preferably used are water which has been subjected to a deionization treatment in which Ca and Mg ions are reduced to the concentration of 5 mg/liter or less with ion exchange resins, and water which has been sterilized with halogen or a ultraviolet sterilizing light.

Tap water may be used for correcting water evaporated from the respective processing solutions. Preferably used is deionized or sterilized water preferably used in the above washing step.

Further, an overflowing solution from the washing step or the stabilizing step is preferably flowed in the bath having a fixing ability which is the preceding bath since a waste amount can be reduced.

In processing, a suitable amount of water, a correction solution or a replenishing solution is preferably added not only to the bleaching solution, bleach-fixing solution and fixing solution but also to the other processing solutions (for example, the color developing solution, washing water and stabilizing solution) in order to correct for the enrichment attributable to evaporation.

The effect of the present invention can be effectively demonstrated especially when the total processing time until the start of the drying step followed the bleaching step is 1 to 3 minutes, preferably 1 minute and 20 seconds to 2 minutes.

In the present invention, the drying temperature is preferably 50° to 65° C., more preferably 50° to 60° C. The drying time is preferably 30 seconds to 2 minutes, more preferably 40 to 80 seconds.

The light-sensitive material used in the present invention may be provided on a support with at least one of the silver halide emulsion layers comprising a blue-sensitive layer, a green-sensitive layer and a red-sensitive layer, and there are specifically no limits to the number and order of the silver halide emulsion layers and light-insensitive layers.

One typical example is a silver halide color photographic light-sensitive material having on a support a light-sensitive layer comprising a plurality of the silver halide emulsion layers having substantially the same spectral sensitivities but different sensitivities, wherein the light-sensitive layer comprises a unit light-sensitive layer having spectral sensitivity to any of blue light, green light and red light. In a multi-layer silver halide color photographic light-sensitive material, the unit light-sensitive layers of a red-sensitivity, a green-sensitivity and a blue sensitivity are usually provided in order from the support side. According to purposes, however, the above order may be changed or a layer having a different spectral sensitivity can be interposed between the layers having the same spectral sensitivity.

Various light-insensitive layers such as an intermediate layer may be provided between the above silver halide light-sensitive layers and on the uppermost or lowermost layer.

The intermediate layer may contain the couplers described in JP-A-61-43748, JP-A-59-113438, JP-A-59-113440, JP-A-61-20037, and JP-A-61-20038 and further may contain an anti-color mixing agent, a ultraviolet absorber and an anti-stain agent, as usually used.

The plurality silver halide emulsion layers constituting the respective until light-sensitive layers can preferably have two layer structures consisting of a high-sensitive layer and low-sensitive layer, as described in German Patent 1,121,470 or British Patent 923,045. Usually, a lower-sensitive layer is provided more closely to the support. Also, a light-insensitive layer may be provided between the respective silver halide emulsion layers.

A lower-sensitive layer may be provided farther from the support and a high-sensitive layer more closely, as described in JP-A-57-112751, JP-A-62-200350, JP-A-62-206541, and JP-A-62-206543.

A concrete example is to provide the layers from the side farthest from the support in the order of a low blue-sensitive layer (BL)/a high blue-sensitive layer (BH)/a high green-sensitive layer (GH)/a low green-sensitive layer(GL)/a high red-sensitive layer (RH)/a low red-sensitive layer (RL), the order of BH/BL/GL/GH/RH/RL, or the order of BH/BL/GH/GL/RL/RH.

Further, the layers can be provided from the side farthest from the support in the order of a blue-sensitive layer/GH/RH/GL/RL, as described in JP-B-55-34932. The layers can also be provided from the side farthest from the support in the order of a blue-sensitive layer/GL/RL/GH/RH, as described in JP-A-56-25738 and JP-A-62-63936. There can be given the structure of three layers having the different sensitivities, respectively, comprising a high sensitive silver halide emulsion layer provided on the uppermost side, a middle sensitive silver halide emulsion layer provided on an intermediate side, and a low sensitive silver halide emulsion layer provided on a lower side, as described in JP-B-49-15495, wherein the sensitivity becomes lower toward the support, as described in JP-B-49-15495. Also in the case of the above structure of three layers having the different sensitivities, the layers having the same spectral sensitivity may be provided from the side farthest from the support in the order of an intermediate-sensitive emulsion layer/a high-sensitive emulsion layer/a low-sensitive emulsion layer, as described in JP-A-59-02464. Various layer structures and layer arrangements can be selected according to the purposes of the light-sensitive material as described above.

The dry thickness of the whole constituent layers excluding a support, subbing layer and a back layer, is preferably 12.0 to 20.0 μm, more preferably 12.0 to 18.0 μm from the viewpoint of bleaching fog and aging stain.

The film thickness of a light-sensitive material is measured in the following manner; at the light-sensitive material to be measured is stored for 7 days under conditions of 25° C. and 50% RH after the preparation thereof; the whole thickness of the light-sensitive material is measured and then, after removing the layers coated on the support, the thickness of the light-sensitive material is measured once again; and the film thickness of the whole coated layers excluding the support of the above light-sensitive material is defined by the difference thereof. This thickness can be measured with a film thickness measuring device K-402B Stand. manufactured by Anritsu Electric Co., Ltd., using a contact type piezoelectric conversion element. The coated layers on the support can be removed with an aqueous sodium hypochlorite solution. The section of the light-sensitive material can be photographed with a scanning type electron microscope (magnification: preferably 3000 or more) to measure the whole layer thickness coated on the support.

In the present invention, the swelling rate is preferably 50 to 200%, more preferably 70 to 150%, wherein the swelling rate is defined by the following equation:

$$\text{Swelling rate} = (A-B)/B \times 100\ (\%)$$

A: equilibrium swollen film thickness in water at 25° C.

B: total dry film thickness at 25° C. and 55% RH.

The swelling rate derivating from the above limits increases the residual amount of the color developing agent and badly affects the photographic properties, the image quality such as the desilvering property and the film properties such as film strength.

Further, the swelling speed of the light-sensitive material represented by T ½ is preferably 15 seconds or less, more preferably 9 seconds or less, wherein T 1/2 is defined as the time spent until the swelling reaches one half of a saturated swollen film thickness which is defined as 90% of the maximum swollen film thickness attained when the light-sensitive material is processed in a color developing solution at 38° C. for 3 minutes and 15 seconds.

Silver halides contained in the photographic emulsion layer of the light-sensitive material used in the present invention may be any of silver iodobromide, silver iodochlorobromide, silver chlorobromide, silver bromide and silver chloride.

Preferred silver halide is silver iodobromide, silver iodochloride or silver iodochlorobromide containing silver iodide in the amount of 0.1 to 30 mole %. Particularly preferred is silver iodobromide containing silver iodide in the amount of 2 to 25 mole %.

The silver halide grains contained in a photographic emulsion may be of a regular crystal such as cube, octahedron or tetradecahedron, an irregular crystal such as sphere or plate, a defective crystal such as twinned crystal, or a composite thereof.

Silver halide may comprise fine grains having a size of about 0.2 μm or less, or large grains having a projected area diameter up to 10 μm and a silver halide emulsion may be polydispersed or monodispersed.

The silver halide photographic emulsion used in the present invention can be prepared by the methods described in, for example, *Research Disclosure* (*RD*) No. 17643 (December 1978), pp. 22 to 23, "I. Emulsion Preparation and Types" and No. 18716 (November 1979), p. 648, *Chimie et Physique Photographique*, by P. Glafkides, published by Paul Montel Co. (1967), *Photographic Emulsion Chemistry*, by G. F. Dufin, published by Focal Press Co. (1966), and *Making and Coating Photographic Emulsion*, by V. L. Zelikman el al, published by Focal Press Co. (1964).

Also preferred are the monodispersed emulsions described in U.S. Pat. Nos. 3,574,628 and 3,655,394, and British Patent 1,413,748. The tabular grains having an aspect ratio of 5 or more can also be used in the present invention. The tabular grains can be prepared by the methods described in *Photographic Science and Engineering*, by Gutoff, vol. 14, pp. 248 to 257 (1970), U.S. Pat. Nos. 4,434,226, 4,414,310, 4,430,048, and 4,439,520, and British Patent 2,112,157.

The crystal structure may be uniform or of a different halogen composition on the inside and a surface or of a stratum structure. Further, silver halides of different compositions may be conjugated with an epitaxial conjugation. Furthermore, silver halides may be conjugated with the compounds other than silver halides, such as silver rhodanide and lead oxide.

Further, a mixture of the grains having the different crystal forms may be used.

Usually, the silver halide emulsions are subjected to physical ripening, chemical ripening and spectral sensitization before use. The additives used in such steps are described in *Research Disclosure*, No. 17643 (December 1978), No. 18716 (November 1979) and No. 307105 (November 1989), and the corresponding passages are listed in the following table.

The publicly known photographic additives also are described in the above three Research Disclosures (RD) and the corresponding passages described therein are listed as well in the following table:

| Resin (f) A mixture of the following: | |
|---|---|
| 2-Hydroxyethyl methacrylate | 100 parts |
| 2-Ethylhexyl methacrylate | 400 parts |
| Styrene | 100 parts |
| Methyl methacrylate | 400 parts |
| Azobisisobutyronitrile | 50 parts |

In the present invention, various color couplers can be used in combination. Representative examples thereof are described in the patents described in above RD No. 17643, VII-C to G and RD No. 307105, VII-C to G.

Preferred are the yellow couplers described in, for example, U.S. Pat. Nos. 3,933,501, 4,022,620, 4,326,024, 4,401,752 and 4,248,961, JP-B-58-10739, British Patent 1,425,020 and 1,476,760, U.S. Pat. Nos. 3,973,968, 4,314,023, and 4,511,649, European Patent 249,473A, and JP-A-3-131847. Further, 1-alkylcyclopropylcarbonyl type or indolinylcarbonyl type yellow couplers having high absorptivity and high fastness to moisture and heat as described in, for example, Japanese Patent Application Nos. 2-64718, 2-314522, 2-232857, 2-26341 and 2-296401 are particularly preferred.

Diequivalent and/or tetraequivalent 5-pyrazolone type and pyrazoloazole type compounds are preferred as a magenta coupler. Further preferred are the compounds described in U.S. Pat. Nos. 4,310,619 and 4,351,897, European Patent No. 73,636, U.S. Pat. Nos. 3,061,432 and 3,725,064, RD No. 24220 (June 1984), JP-A-60-33552, RD No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO (PCT) 88/04795.

In the present invention, the use of at least one kind of the tetraequivalent magenta coupler can provide marked effects.

Of the tetraequivalent magenta couplers, preferred are the tetraequivalent 5-pyrazolone type magenta couplers represented by the following formula (M) or the tetraequivalent pyrazoloazole type magenta couplers represented by the following formula (m):

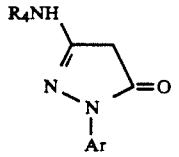

(M)

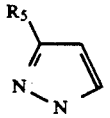

(m)

in formula (M), $R_4$ represents an alkyl group, an aryl group, an acyl group, or a carbamoyl group; Ar represents a substituted or unsubstituted phenyl group, provided that either of $R_4$ and Ar may be a polyvalent group having a divalency or a higher valency to form a polymer, such as a dimer, and that it may link a main coupling structure of the coupler with a principal chain of a polymer to form a polymer coupler; in formula (m), $R_5$ represents a hydrogen atom or a substituent; and Z represents a group of non-metallic atoms necessary to form a 5-membered azole ring containing 2 to 4 nitrogen atoms, and the azole ring may have a substituent or a condensed ring, provided that either of $R_5$ and Z may be a polyvalent group having a divalency or a higher valency to form a polymer, such as a diamer, and that it may link a main coupling structure of the coupler with a principal chain of a polymer to from a polymer coupler.

In $R_4$ of formula (M), the alkyl group represents a linear or branched alkyl group having 1 to 42 carbon atoms, an aralkyl group, an alkenyl group, an alkynyl group, a cycloalkyl group, or a cycloalkenyl group; the aryl group represents an aryl group having 6 to 46 carbon atoms; the acyl group represents an aliphatic acyl group having 2 to 32 carbon atoms or an aromatic acyl group having 7 to 46 carbon atoms; and the carbamoyl group represents an aliphatic carbamoyl group having 2 to 32 carbon atoms or an aromatic carbamoyl group having 7 to 46 carbon atoms. These groups may have substituents, which are organic substituents having a carbon atom, oxygen atom, nitrogen atom or sulfur atom at a bonding site, or halogen atoms.

In more detail, $R_4$ represents an alkyl group (for example, methyl, ethyl, butyl, propyl, octadecyl, isopropyl, t-butyl, cyclopentyl, cyclohexyl, methoxyethyl, ethoxyethyl, t-butoxyethyl, phenoxyethyl, methanesulfonylethyl, and 2-(2,4-di-tert-amyphenoxy) ethyl); an aryl group (for example, phenyl, 2-chlorophenyl 2-methoxyphenyl, 2-chloro -5-tetradecaneamidephenyl, 2-chloro-5-(3-octadecenyl-1-succinimide) phenyl, 2-choloro-5-octadecylsulfonamidephenyl, and 5-chloro-5-[2-(4-hydroxy-3-tert-butylphenoxy) tetradecanamidephenyl]); an acyl group (for example, acetyl, pivaloyl, tetradecanoyl, 2-(2,4-di-tert-pentylphenoxy) acetyl, 2-(2,4-di-tert-pentylphenoxy) butanoyl, benzoyl, and 3-(2,4-di- tert-amylphenoxyacetamide) benzoyl; a carbamoyl group (for example, N-methylcarbamoyl, N,N-dimethylcarbamoyl, N-hexadecylcarbamoyl, N-methyl-N-phenylcabamoyl, and N-[3-(1-(2,4-di-tert-phentylphenoxy) butylamide)]-phenylcarbamoyl.

Examples of the substituents of these groups include an alkyl group, an aryl group, a heterocyclic group, a cyano group, a hydroxy group, a nitro group, a carboxy group, an amino group, an acyl group, an aryloxycarbonyl group, an alkoxycarboxy group, a carbamoyl group, an alkoxy group, an aryloxy group, a heterocyclicoxy group, an acyloxy group, a carbamoyloxy group, a silyloxy group, an aryloxycarbonylamino group, an acylamino group, an alkylamino group, an anilino group, a ureido group, a sufamoylamino group, an alkoxycarbonylamino group, a sulfonamide group, an aryloxycarbonylamino group, an imide group, an alkylthio group, an arylthio group, a heterocyclicthio group, a sulfamoyl group, a sulfonyl group, a sulfinyl group, an azo group, a phosphonyl group, an azolyl group, a fluorine atom, a chlorine atom, and a bromine atom. $R_4$ is preferably an aryl group and an acyl group.

Ar in formula (M) represents a substituted or unsubstituted phenyl group. Preferred substituents include a halogen atom, an alkyl group, a cyano group, an alkoxy group, an alkoxycarbonyl group, and an acylamino group.

Ar is, for example, phenyl, 2,4,6-trichlorophenyl, 2,5-dichlorophenyl, 2,4-dimethyl-6-methoxyphenyl, 2,6-dichloro-4-methoxyphenyl, 2,6-dichloro-4-ethoxycarbonylphenyl, 2,6-dichloro-4-cyanophenyl group, or4-[2-(2,4-di-tert-amylphenoxy) butylamide]phenyl. Ar is preferably a substituted phenyl group, more preferably a phenyl group which is substituted with at least one halogen atom (particularly a chlorine atom) and particularly preferably 2,4,6-trichlorophenyl or 2,5-dichlorophenyl.

Of the pyrazoloazole type magenta couplers represented by formula (m), preferred are the compounds having the skeletal structure of 1H-imidazo [1,2-b]pyrazole, 1H-pyrazolo [1,5-b] [1,2,4] triazole, 1H-pyrazolo [5,1-c][1,2,4] triazole, or 1H-pyrazolo [1,5-d] tetrazole. They are represented by the following formulas (m-1), (m-2), (m-3) and (m-4), respectively:

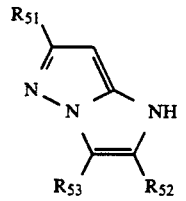
(m-1)

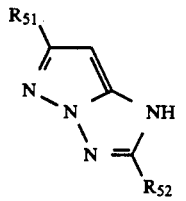
(m-2)

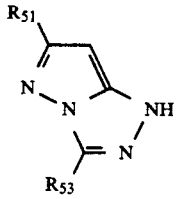
(m-3)

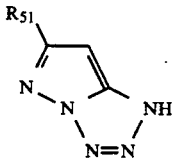
(m-4)

$R_5$, $R_{51}$, $R_{52}$, and $R_{53}$, in formula (m) and these formulas are explained below.

$R_5$ and $R_{51}$ represent independently a hydrogen atom and a substituent. The substituent may be a halogen atom, an alkyl group, an aryl group, a heterocyclic group, a cyano group, a hydroxy group, a sulfo group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acryloxy group, a carbamoyloxy group, a silyloxy group, an aryloxycarbonylamino group, an imide group, a heterocyclicthio group, a sulfinyl group, a phosphonyl group, an aryloxycarbonyl group, an acyl group, and an azolyl group. $R_5$ and $R_{51}$ may be divalent to form a bis product.

In further detail, $R_5$ and $R_{51}$ represent independently a hydrogen atom, a halogen atom (for example, a chlorine atom and a bromine atom), an alkyl group (for example, a linear or branched alkyl group having 1 to 32 carbon atoms, an aralkyl group, an alkenyl group, an alkynyl group, a cycloalkyl group, and a cyaloalkenyl group, and more specifically, methyl, ethyl, propyl, isopropyl, t-butyl, tridecyl, 2-methanesulfonylethyl, 3-(3-pentadecylphenoxy) propyl, 3-(4-{2-[4-(4-hydroxyphenylsulfonyl) phenoxy]dodecanamide}phenyl}propyl, 2-ethoxytridecyl, trifluoromethyl, cyclopentyl, and 3-(2,4-di-tert-amylphenoxy) propyl), an aryl group (for example, phenyl, 4-t-butylphenyl, 2,4-di-t-amylphenyl, and 4-tetradecanamidephenyl), a heterocyclic group (for example, 2-furyl, 2-thienyl, 2-pyrimidinyl, and 2-benzothiazolyl), a cyano group, a hydroxy group, a sulfo group, a nitro group, a carboxy group, an amino group, an alkoxy group (for example, methoxy, ethoxy, 2-methoxyethoxy, 2-dodecyloxyethoxy, and 2-methanesulfonylethoxy), an aryloxy group (for example, phenoxy, 2-methylphenoxy, 4-t-butylphenoxy, 3-nitrophenoxy, 3-t-butyloxycarbamoylphenoxy, and 3-methoxycarbamoylphenoxy), an acylamino group (for example, acetamide, benzamide, tetradecanamide, 2-(2,4-di-t-amylphenoxy) butanamide, 4-(3-t-butyl-4-hydroxyphenoxy) butanamide, and 2-[4-(4-hydroxyphenylsufonyl) phenoxy]decanamide), an alkylamino group (for example, methylamino, butylamino, dodecylamino, diethylamino, and methylbutylamino), an anilino group (for example, phenylamino, 2-chloroanilino, 2-chloro-5-tetradecanaminoanilino, 2-chloro-5-dodecyloxycarbonylanilino, N-acetylanilino, and 2-chloro-5-[α-(3-t-butyl-4-hydroxyphenoxy) dodecaneamide]anilino), a ureido group (for example, phenylureido, methylureido and N,N-dibutylureido), a sulfamoylamino group (for example, N,N-dipropylsulfamoylamino, and N-methyl-N-decylsulfamoylamino), an alkylthio group (for example, methylthio, octylthio, tetradecylthio, 2-phenoxyethylthio, 3-phenoxypropylthio, and3-(4-t-butylphenoxy) propylthio), an arylthio group (for example, phenylthio, 2-butoxy-5-t-octylphenylthio, 3-pentadecylphenylthio, 2carboxyphenylthio, and 4-tetradecanamidephenylthio), an alkoxycarbonylamino group (for example, methoxycarbonylamino and tetradecyloxycarbonylamino), a sulfonamide group (for example, methanesulfonamide, hexadecanesulfonamide, benzenesulfonamide, p-toluenesulfonamide, octadecanesulfonamide, and 2-methoxy-5-t-butylbenzenesulfonamide), a carbamoyl group (for example, N-ethylcarbamoyl, N,N-dibutylcarbamoyl, N-(2-dodecyoxyethyl) carbamoyl, N-methyl-N-dodecylcarbamoyl, and N-[3-(2,4-di-t-amylphenoxy) propyl]carbamoyl), a sulfamoyl group (for example, N-ethylsulfamoyl, N,N-dipropylsulfamoyl, N-(2-dodecyloxyethyl) sulfamoyl, N-ethyl-N-dodecylsulfamoyl, and N,N-diethylsulfamoyl), a sulfonyl group (for example, methanesulfonyl, octanesulfonyl, benzenesulfonyl, and toluenesulfonyl), an alkoxycarbonyl group (for example, methoxycarbonyl, butyloxycarbonyl, dodecyloxycarbonyl, and octadecyloxycarbonyl), a heterocyclicoxy group (for example, 1-phenyltetrazole-5-oxy, and 2-tetrahydropyranyloxy), an azo group (for example, phenylazo, 4-methoxyphenylazo, 4-pivaloylaminophenylazo,and 2-hydroxy-4-propanoylphenylazo), and 2-hydroxy-4-propanoylphenylazo), an acyloxy group (for example, acetoxy), a carbamoyloxy (for example, N-methylcarbamoyloxy and N-phenylcarbamoyloxy), a silyloxy group (for example, trimethylsilyloxy and dibutylmethylsilyloxy), an aryloxycarbonylamino group (for example, phenoxycarbonylamino), an imide group (for example, N-succinimide, N-phthalimide, and 3-octadecenylsuccinimide), a heterocyclicthio group (for example, 2-benzothiazolylthio, 2,4-di-phenoxy-1,3,5-triazole-6-thio, and 2-pyridylthio), a sulfinyl group (for example, dodecanesulfinyl, 3-pentadecylphenylsulfinyl, and 3-phenoxypropylsulfinyl), a phosphonyl group (for example, phenoxyphosphonyl, octyloxyphosphonyl, and phenylphosphonyl), an aryloxycarbonyl group (for example, phenoxycarbonyl), an acyl group (for example, acetyl, 3-phenylpropanoyl, benzoyl, and dodecyloxybenzoyl), and an azolyl group (for example, imidazolyl, pyrazolyl, 3-chloro-pyrazole-1-yl, and triazoyl).

Of these groups, the groups capable of having further substituents may have the organic substituents linked with a carbon atom, an oxygen atom, a nitrogen atom or a sulfur atom, or a halogen atom.

Of these groups, the preferred groups represented by $R_5$ and $R_{51}$ are an alkyl group, an aryl group, an alkoxy group, an aryloxy group, an alkylthio group, a ureido group, a carbomoyloxy group, and an acylamino group.

$R_{52}$ represents the same groups as those defined for $R_{51}$, and preferred are a hydrogen atom, an alkyl group, an aryl group, a heterocyclic group, an alkoxycarbonyl group, a carbamoyl group, a sulfamoyl group, a sulfinyl group, an acyl group, and a cyano group.

$R_{53}$ represents the same groups as those defined for $R_{51}$, and preferred are a hydrogen atom, an alkyl group, an aryl group, a heterocyclic group, an alkoxy group, an aryloxy group, an alkylthio group, and arylthio group, an alkoxycarbonyl group, a carbamoyl group, and an acyl group. More preferred are an alkyl group, an aryl group, a heterocyclic group, an alkylthio group, and an arylthio group.

The magenta couplers represented by formulas (m-1), (m-2), (m-3) and (m-4) can be synthesized by the methods disclosed in U.S. Pat. Nos. 4,540,654, 4,705,863, 3,725,067, 2,710,871, 3,684,514, 3,928,044 and 3,928,044.

The polymer product of the magenta coupler of formula (M) or (m) is disclosed in JP-B-2-44051.

Examples of the tetraequivalent magenta coupler are shown below:

(M-1)

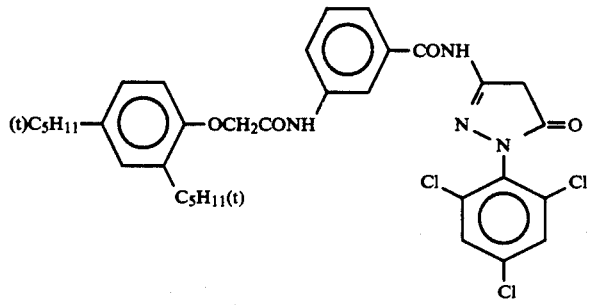

-continued
(M-2)
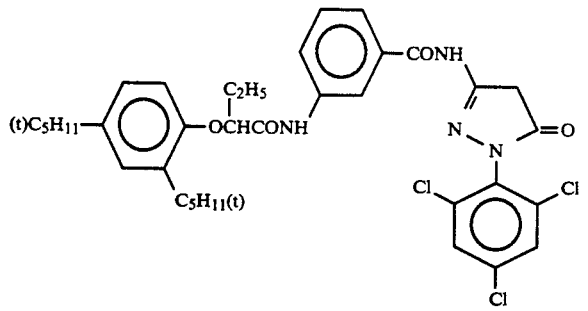
(M-3)
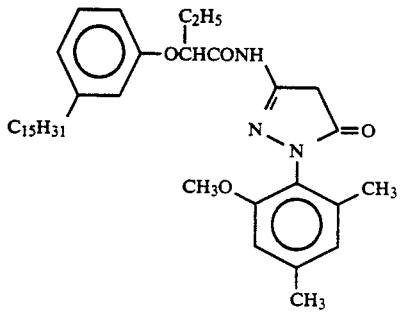
(M-4)
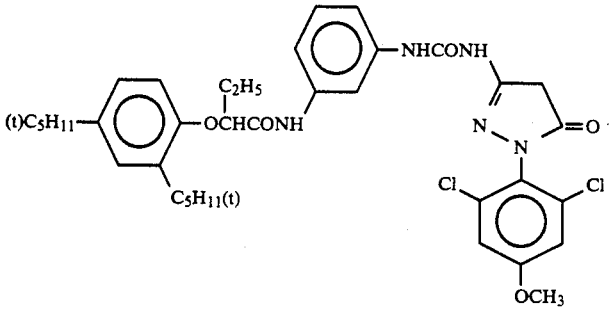
(M-5)
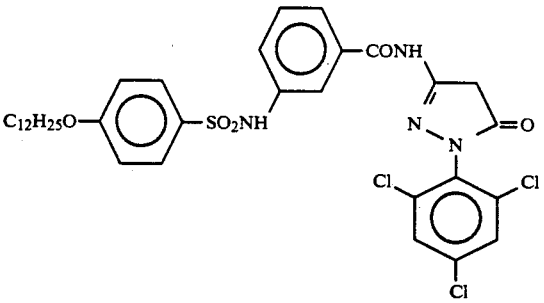
(M-6)
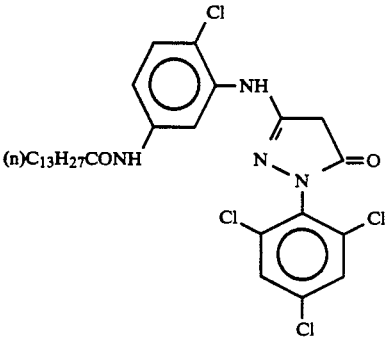

-continued
(M-7)
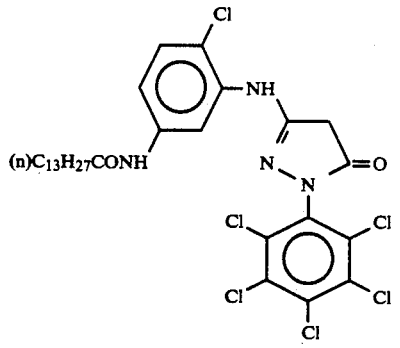
(M-8)
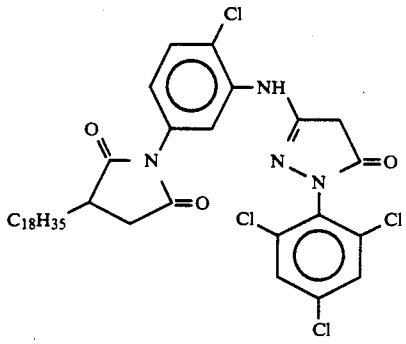
(M-9)
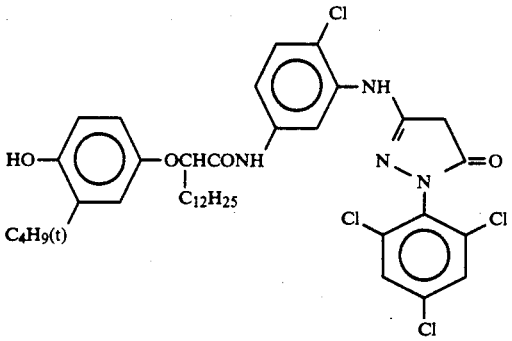
(M-10)
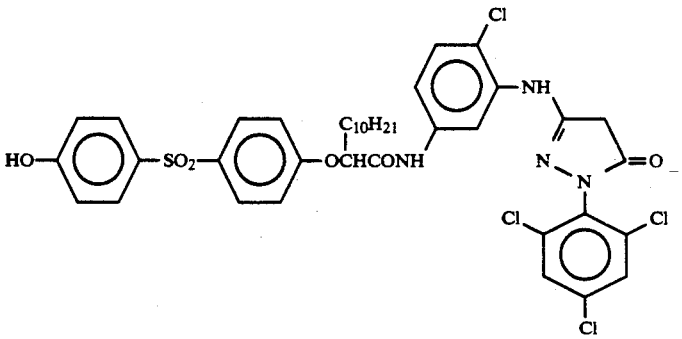

-continued
(M-11)
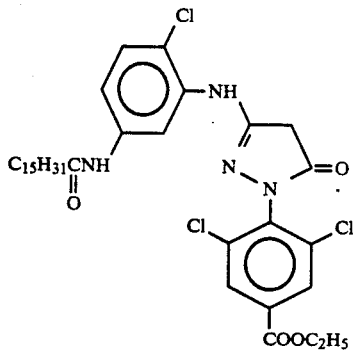
(M-12)
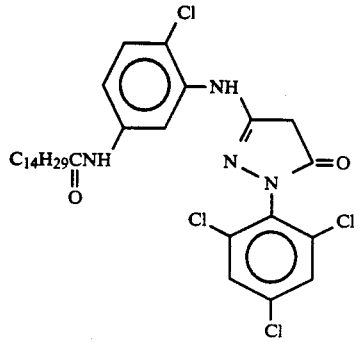
(M-13)
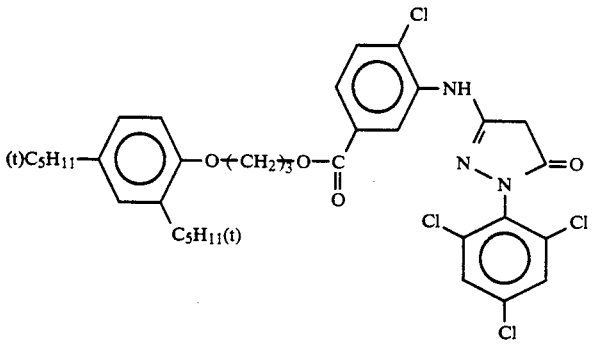
(M-14)
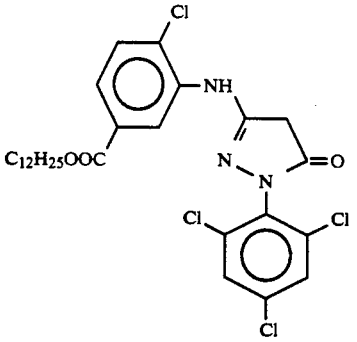
(M-15)
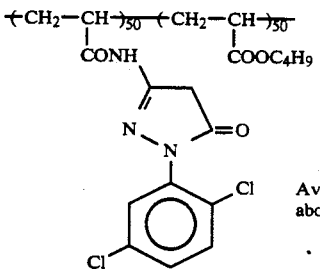
Average Molecular Weight: about 25,000

-continued
(M-16)
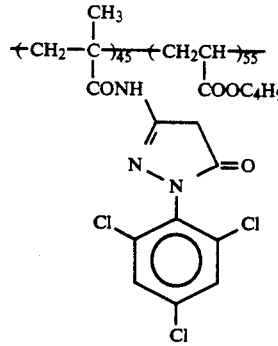
Average Molecular Weight: about 30,000
(M-17)
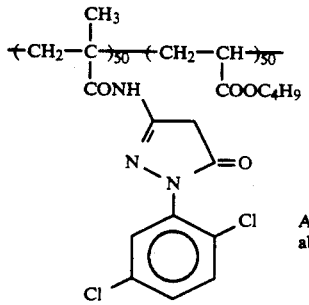
Average Molecular Weight: about 30,000
(M-18)
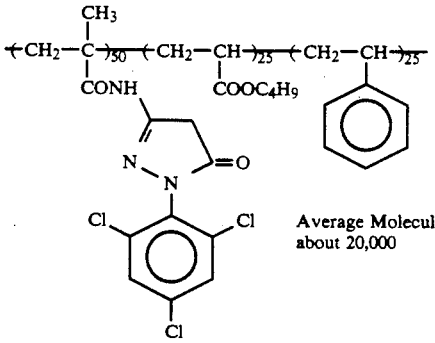
Average Molecular Weight: about 20,000
(M-19)
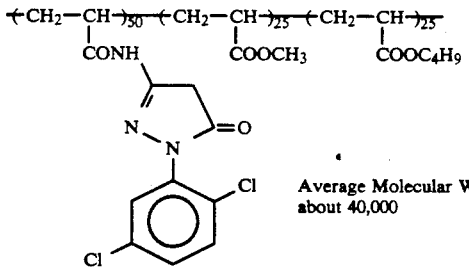
Average Molecular Weight: about 40,000
(M-20)
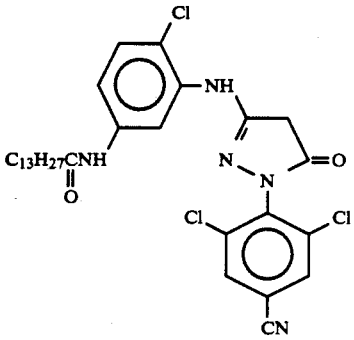

-continued
(M-21)
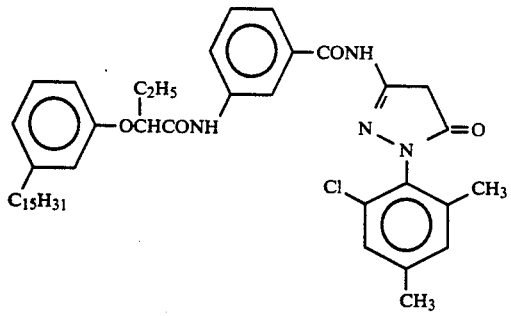
(M-22)
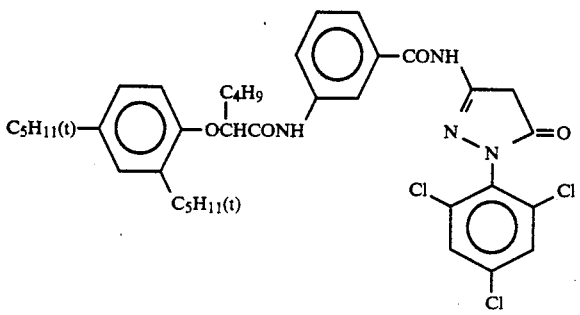
(M-23)
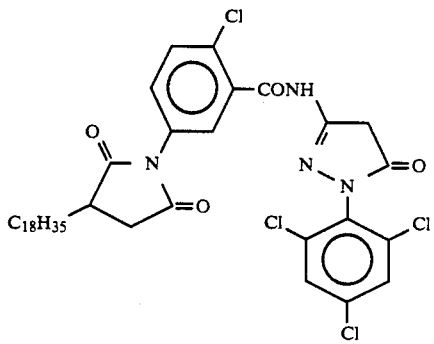
(M-24)
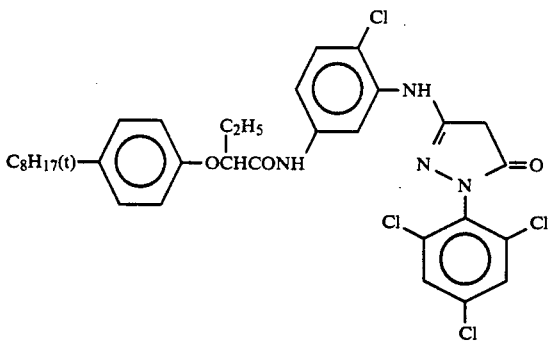
(M-25)
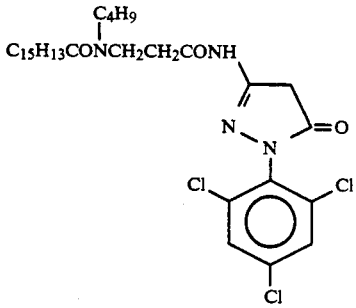

-continued
(M-26)
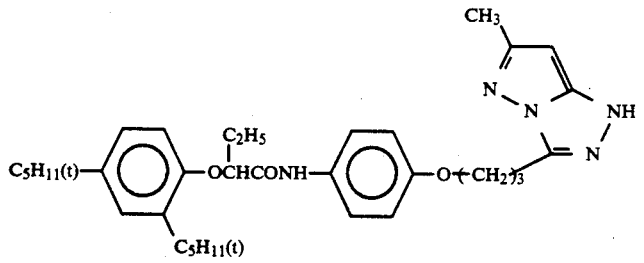
(M-27)
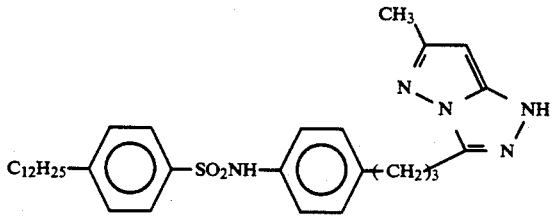
(M-28)
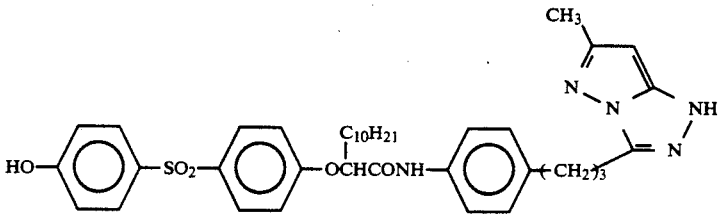
(M-29)
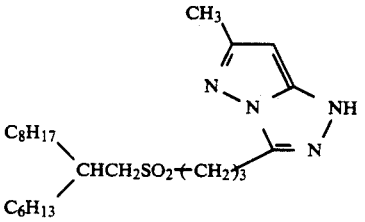
(M-30)
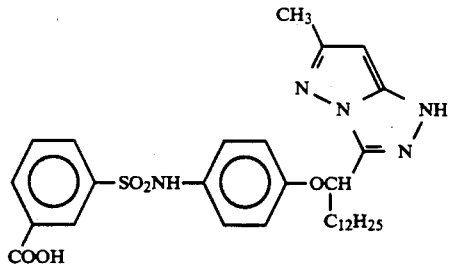
(M-31)
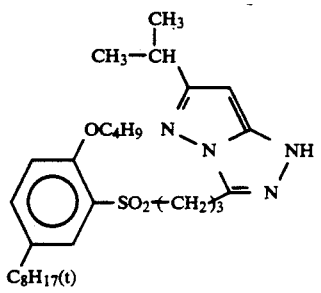

-continued
(M-32)
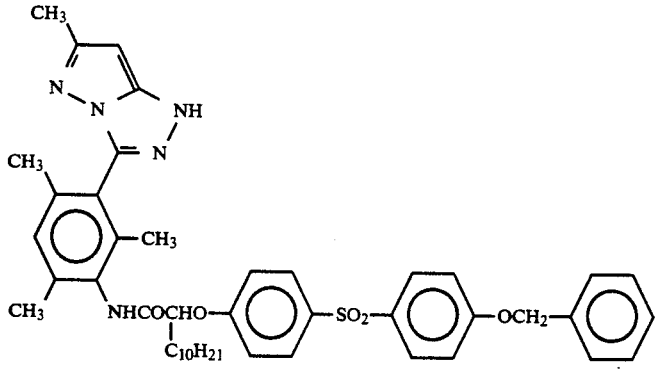
(M-33)
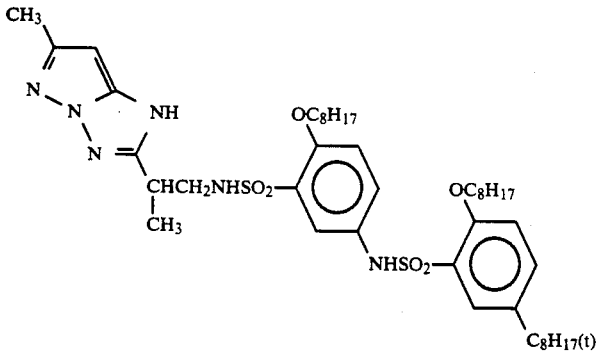
(M-34)
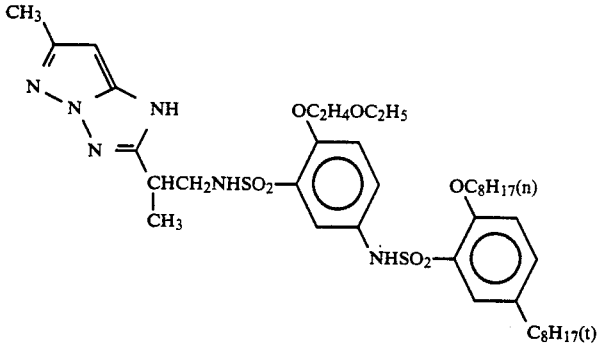
(M-35)
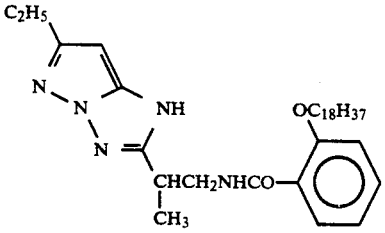
(M-36)
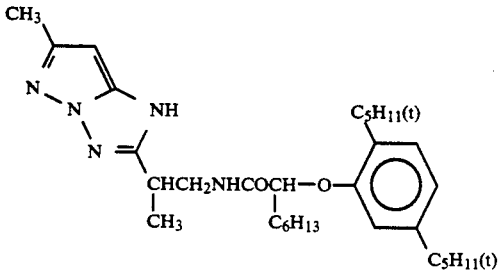

-continued
(M-37)
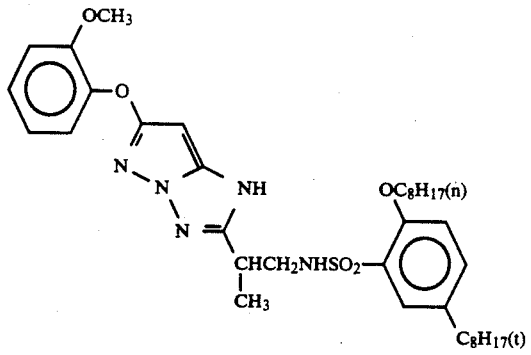
(M-38)
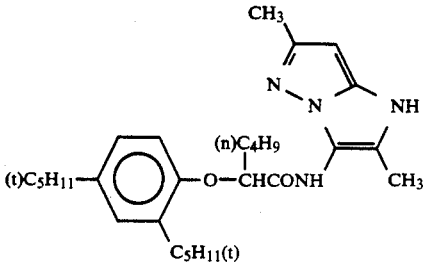
(M-39)
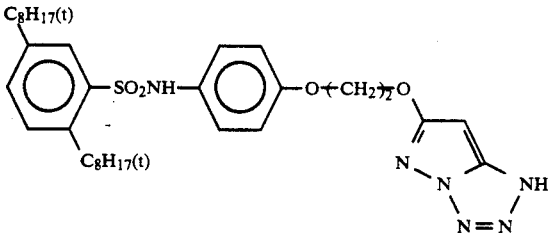
(M-40)
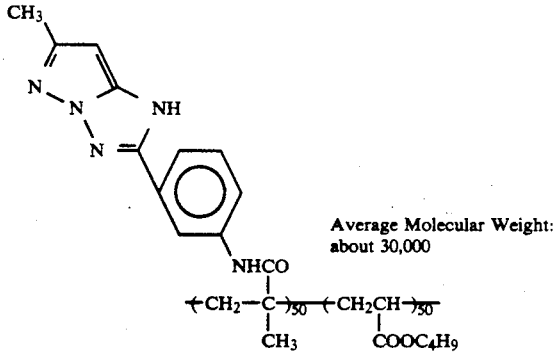
(M-41)
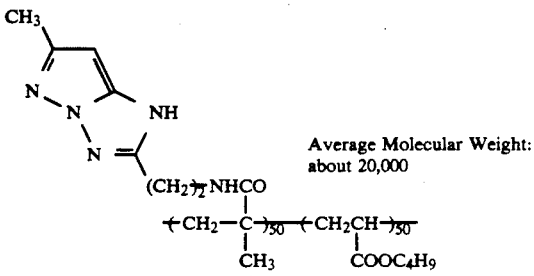

-continued (M-42)

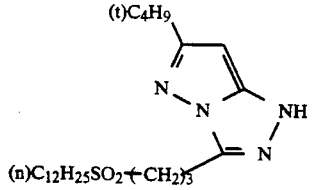

In the above, the ratios of repeating units are by weight.

The use of the tetraequivalent 5-pyrazolone type magenta coupler of formula (M) can particularly demonstrate the effects of the present invention.

In the present invention, the coated amount of the tetraequivalent magenta coupler is preferably $0.4\times10^{-3}$ to $3.5\times10^{-3}$ mole per $m^2$ of the light-sensitive material. This coupler can be used in combination with a diequivalent magenta coupler without causing any problem.

There can be mentioned as a cyan coupler the phenol and naphthol type couplers. Preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173; German Patent (OLS) 3,329,729; European Patents 121,365A, and 249,453A; U.S. Pat. Nos. 3,446,622, 4,333,999, 4,753,871, 4,451,559, 4,427,767, 4,690,889, 4,254,212, and 4,296,199; and JP-A-61-42658, and JP-A-3-196037. Particularly preferred are pyrrolotriazole, pyrroloimidazole, imidazopyrazole, imidazole, pyrazolotriazole, and cyclic active methylene type cyan couplers described in Japanese Patent Application Nos. 2-302078, 2-322051, 3-226325, and 3-236894, JP-A-32260 and JP-A-2-141745.

Preferred as a colored coupler used for correcting any unnecessary absorption of a formed image are the compounds described in RD No. 17643, VII-G, U.S. Pat. No. 4,163,670, JP-B-57-39413, U.S. Pat. Nos. 4,004,929 and 4,138,258, British Patent No. 1,146,368, and Japanese Patent Application No. 2-50137. Also, preferably used are the couplers which correct any unnecessary absorption of a formed image with a fluorescent dye released in coupling, described in U.S. Pat. No. 4,774,181, and the couplers having as a releasing group a dye precursor group capable of reacting with a developing agent to form a dye, described in U.S. Pat. No. 4,777,120.

Preferred as a coupler capable of forming a dye having an appropriate diffusing property are the compounds descried in U.S. Pat. No. 4,366,237, British Patent No. 2,125,570, European Patent 96,570, and German Patent (OLS) 3,234,533.

The typical examples of a dye-forming polymer coupler are described in U.S. Pat. Nos. 3,451,820, 4,080,211, 4,367,282, 4,409,320, and 4,576,910, and British Patent No. 2,102,173.

Also, there can be preferably used a coupler releasing a photographically useful residue by coupling. Preferred as a coupler releasing imagewise a nucleus-forming agent or a development accelerator in developing are the couplers described in British Patents 2,097,140 and 2,131,188, and JP-A-59-157638 and JP-A-59-170840.

In addition to the above, there are given as couplers capable of being used in light-sensitive material, the competitive couplers described in U.S. Pat. No. 4,130,427; the couplers releasing a dye whose color is recovered after releasing, described in European Patent 173,302A; the bleaching accelerator-releasing couplers described in RD No. 11449 and 24241, and JP-A-61-201247; the ligand-releasing couplers described in U.S. Pat. No. 4,553,477; the couplers releasing a leuco dye described in JP-A-63-75747; and the couplers releasing a fluorescent dye described in U.S. Pat. No. 4,774,181.

The couplers used in the present invention can be incorporated into a light-sensitive material by various conventional dispersing methods.

Examples of a high boiling-solvent used in an oil-in-water dispersion method are described in U.S. Pat. No. 2,322,027. Representative examples of the high-boiling organic solvent which has a boiling point at normal pressure of 175° C. or higher and is used in the oil-in-water dispersion method include phthalic esters (dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), phosphoric or phosphonic esters (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexyl phosphonate), benzoic esters (2-ethylhexyl benzoate, dodecyl benzoate, and 2-ethylhexyl-p-hydroxybenzoate), amides (N,N-diethyldecanamide, N,N-diethyllaurylamide, and N-tetradecylpyrrolidone), alcohols and phenols (isostearyl alcohol and 2,4-di-tert-amylphenol), aliphatic carboxylic esters (bis(2-ethylhexyl) sebacate, dioctyl azelate, glycerol tributylate, isostearyl lactate, and trioctyl citrate), aniline derivatives (N,N-dibutyl-2-butoxy-5-tert-octyl-aniline), and hydrocarbons (paraffin, dodecylbenzene, and diisopropylnaphthalene).

There can be used as an auxiliary solvent, organic solvents having a boiling point of about 30° C. or higher, preferably 50° C. or higher and about 160° C. or lower. Typical examples thereof include ethyl acetate, butyl acetate, ethyl propionate, methyl ethyl ketone, cyclohexanone, 2-ethoxyethyl acetate, and dimethylformamide.

Concrete examples of the steps and effect of a latex dispersing method and latexes for impregnation are described in U.S. Pat. No. 4,199,363, and German Patents (OLS) 2,541,274 and 2,541,230.

These couplers can be dispersed and emulsified in a hydrophilic colloid solution after they are impregnated into a loadable latex in the presence or absence of a high-boiling organic solvent (for example, U.S. Pat. No. 4,203,716), or they can be dissolved in a water insoluble and organic solvent-soluble polymer. Preferably used is a homopolymer or copolymer described on pages 12 to 30 of the specification of International Publication No. W088/00723. Particularly, a polyacrylamide type polymer is preferably used in terms of stabilizing a dye image.

A support suitable for use in the present invention is described in, for example, RD No. 17643, p. 28 and No. 18716, p. 647, right column to p. 648, left column.

The present invention can be applied to various light-sensitive materials. Particularly, it is used preferably for color negative films for general purpose and cinema and reversal films for slide and TV.

EXAMPLES

The present invention will be explained in detail with reference to the following examples, but is not limited thereto.

EXAMPLE 1

Layers having the following compositions were provided on a cellulose triacetate film support having thereon a subbing layer to prepare a multi-layered color light-sensitive material Sample No. 101.

Composition of a light-sensitive layer

The coated amounts are expressed in terms of g/m$^2$ of silver for silver halide and colloidal silver, in terms of g/m$^2$ for the couplers, additives and gelatin, and in terms of mole per mole of silver halide for the spectral sensitizers.

| | |
|---|---|
| First layer: an anti-halation layer | |
| Black colloidal silver | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second layer: an intermediate layer | |
| Silver iodobromide fine grains (AgI: 1.0 mole %, circle-corresponding diameter: 0.07 μm) | 0.15 |
| Gelatin | 1.00 |
| ExC-4 | $6.0 \times 10^{-2}$ |
| Cpd-3 | $2.0 \times 10^{-2}$ |
| Third layer: the first red-sensitive layer | |
| Silver iodobromide emulsion (AgI: 5.0 mole %, higher AgI content on surface, circle-corresponding diameter: 0.9 μm, fluctuation coefficient of circle-corresponding diameter: 21%, tabular grains, diameter/thickness ratio: 7.5) | 0.42 |
| Silver iodobromide emulsion (AgI: 4.0 mole %, higher AgI content in inside, circle-corresponding diameter: 0.4 μm, fluctuation coefficient of circle-corresponding diameter: 18%, tetradecahedron grains) | 0.40 |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| Fourth layer: the second red-sensitive layer | |
| Silver iodobromide emulsion (AgI: 8.5 mole %, higher AgI content in inside, circle-corresponding diameter: 1.0 μm, fluctuation coefficient of circle-corresponding diameter: 25%, tabular grains, diameter/thickness ratio: 3.0) | 0.85 |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| Solv-1 | 0.10 |

-continued

| | |
|---|---|
| Fifth layer: the third red-sensitive layer | |
| Silver iodobromide emulsion (AgI: 11.3 mole %, higher AgI content in inside, circle-corresponding diameter: 1.4 μm, fluctuation coefficient of circle-corresponding diameter: 28%, tabular grains, diameter/thickness ratio: 6.0) | 1.50 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| Solv-1 | 0.12 |
| Solv-2 | 0.12 |
| Sixth layer: an intermediate layer | |
| Gelatin | 1.00 |
| Cpd-4 | $8.0 \times 10^{-2}$ |
| Solv-1 | $8.0 \times 10^{-2}$ |
| Seventh layer: the first green-sensitive layer | |
| Silver iodobromide emulsion (AgI: 5.0 mole %, higher AgI content on surface, circle-corresponding diameter: 0.9 μm, fluctuation coefficient of circle-corresponding diameter: 21%, tabular grains, diameter/thickness ratio: 7.5) | 0.28 |
| Silver iodobromide emulsion (AgI: 4.0 mole %, higher AgI content in inside, circle-corresponding diameter: 0.4 μm, fluctuation coefficient of circle-corresponding diameter: 18%, tetradecahedron grains) | 0.16 |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Eighth layer: the second green-sensitive layer | |
| Silver iodobromide emulsion (AgI: 8.5 mole %, higher AgI content in inside, circle-corresponding diameter: 1.0 μm, fluctuation coefficient of circle-corresponding diameter: 25%, tabular grains, diameter/thickness ratio: 3.0) | 0.57 |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth layer: an intermediate layer | |
| Gelatin | 0.50 |
| Solv-1 | $2.0 \times 10^{-2}$ |
| Tenth layer: the third green-sensitive layer | |
| Silver iodobromide emulsion (AgI: 11.3 mole %, higher AgI content in inside, circle-corresponding diameter: 1.4 μm, fluctuation coefficient of circle-corresponding diameter: 28%, tabular grains, diameter/thickness ratio: 6.0) | 1.30 |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Eleventh layer: a yellow filter layer | |
| Gelatin | 0.50 |
| Cpd-6 | $5.2 \times 10^{-2}$ |
| Solv-1 | 0.12 |
| Twelfth layer: an intermediate layer | |
| Gelatin | 0.45 |
| Cpd-3 | 0.10 |
| Thirteenth layer: the first blue-sensitive layer | |
| Silver iodobromide emulsion | 0.20 |

-continued

| | |
|---|---|
| (AgI: 2 mole %, uniform AgI content, circle-corresponding diameter: 0.55 μm, fluctuation coefficient of circle-corresponding diameter: 25%, tabular grains, diameter/thickness ratio: 7.0) | |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Fourteenth layer: the second blue-sensitive layer | |
| Silver iodobromide emulsion (AgI: 19.0 mole %, higher AgI content in inside, circle-corresponding diameter: 1.0 μm, fluctuation coefficient of circle-corresponding diameter: 16%, octahedron grains) | 0.19 |
| Gelatin | 0.35 |
| ExS-7 | $2.0 \times 10^{-4}$ |
| ExY-1 | 0.22 |
| Solv-1 | $7.0 \times 10^{-2}$ |
| Fifteenth layer: an intermediate layer | |
| Silver iodobromide fine grains (AgI: 2 mole %, uniform AgI content, circle-corresponding diameter: 0.13 μm) | 0.20 |
| Gelatin | 0.36 |
| Sixteenth layer: the third blue-sensitive layer | |
| Silver iodobromide emulsions (AgI: 14.0 mole %, higher AgI content in inside, circle-corresponding diameter: 1.7 μm, fluctuation coefficient of circle-corresponding diameter: 28%, tabular grains, diameter/thickness ratio: 5.0) | 1.55 |
| Gelatin | 1.00 |

-continued

| | |
|---|---|
| ExS-8 | $1.5 \times 10^{-4}$ |
| ExY-1 | 0.21 |
| Solv-1 | $7.0 \times 10^{-2}$ |
| Seventeenth layer: the first protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth layer: the second protective layer | |
| Silver chloride fine grains (Circle-corresponding diameter: 0.07 μm) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

There were added to this sample, 1,2-benzoisothiazoline-3-one (average 200 ppm to gelatin), n-butyl-p-hydroxybenzoate (about 1,000 ppm to gelatin), and 2-phenoxyethanol (about 10,000 ppm to gelatin). Further, the sample contained therein, B-4, B-5, W-2, W-3, F-1, F-2, F-3, F-4, F-5, F-6, F-7, F-8, F-9 F-10, F-11, F-12, F-13, iron salts, lead salts, gold salts, platinum salts, iridium salts, and rhodium salts.

The above compounds used are shown below.

UV-1

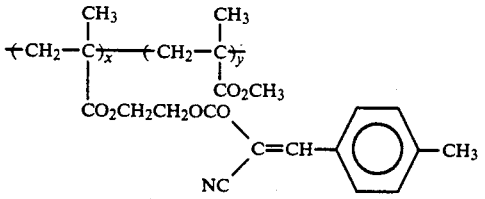

x/y = 7/3 (by weight)

UV-2

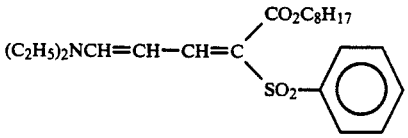

ExC-1

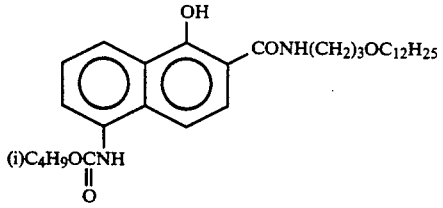

ExC-2

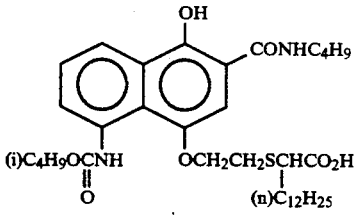

ExC-3

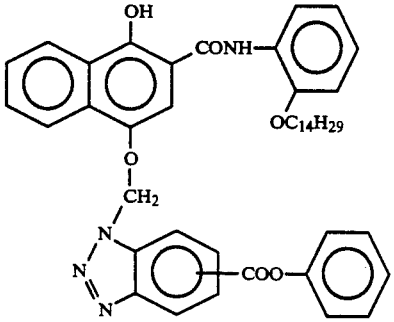

-continued
ExC-4
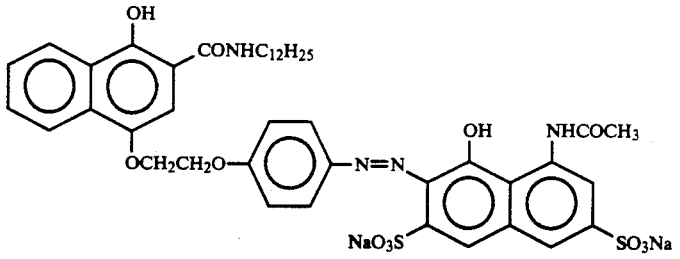
ExC-5
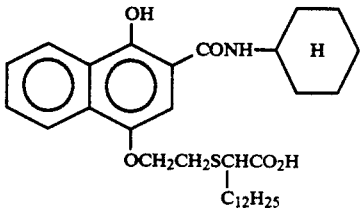
ExM-1
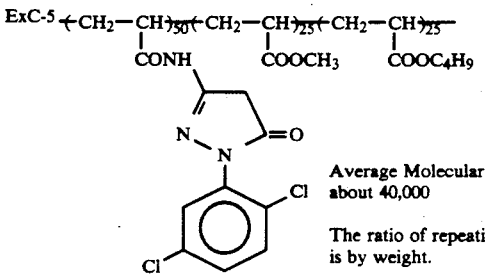
Average Molecular Weight: about 40,000
The ratio of repeating units is by weight.
ExM-2
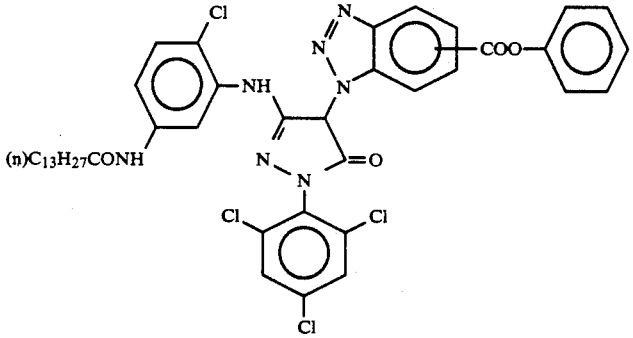
ExM-3
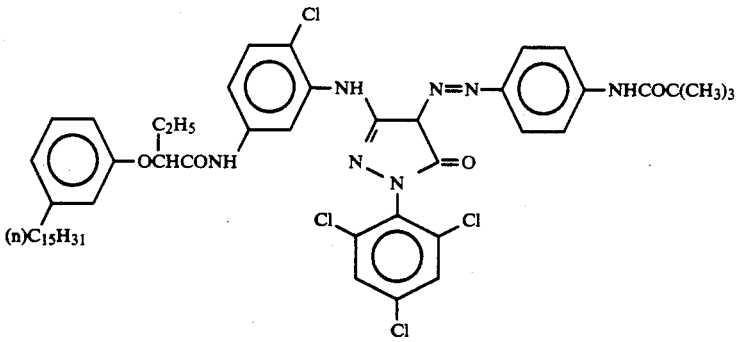
ExM-4
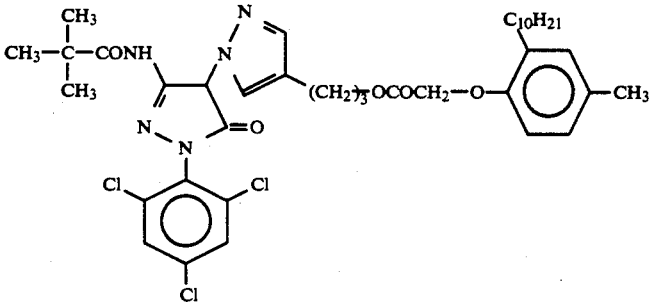

-continued
ExM-5
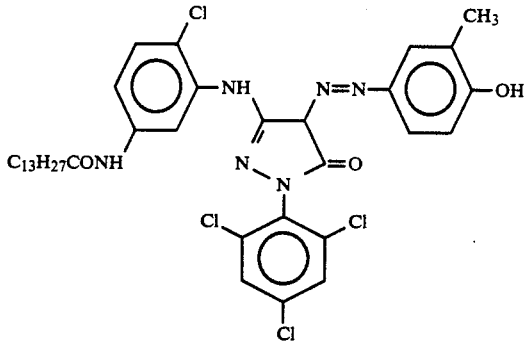
ExM-6
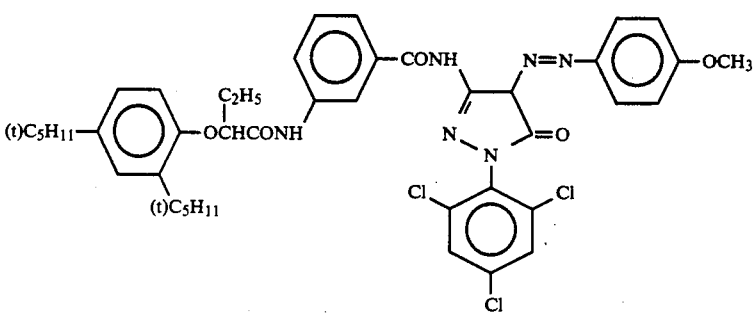
ExY-1
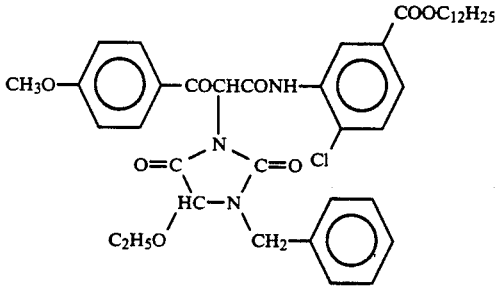
ExY-2
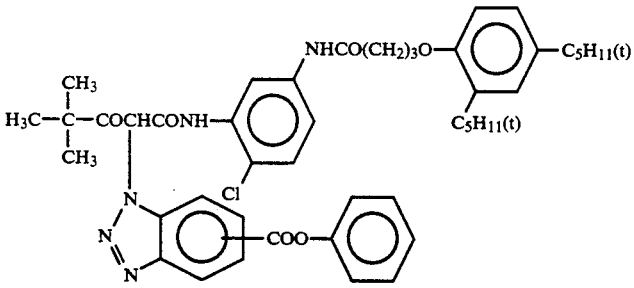
Cpd-1
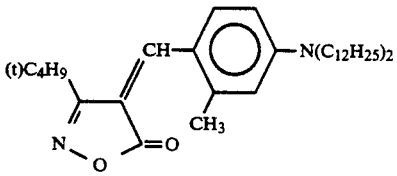
Cpd-2
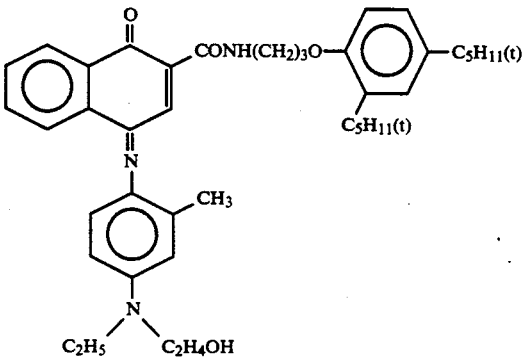

-continued
Cpd-3
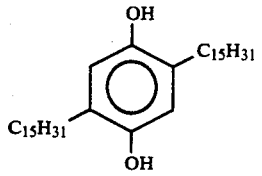
Cpd-4
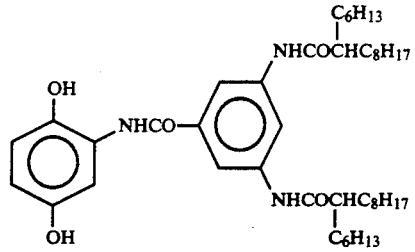
Cpd-5
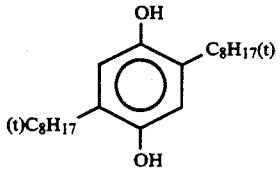
Cpd-6
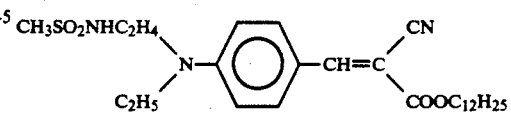
Cpd-7
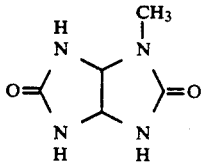
Solv-1
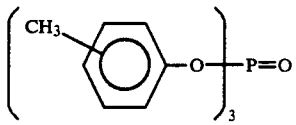
Solv-2
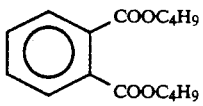
Solv-3
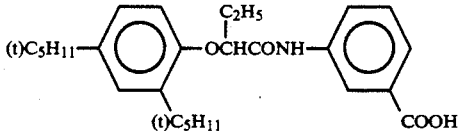
ExS-1
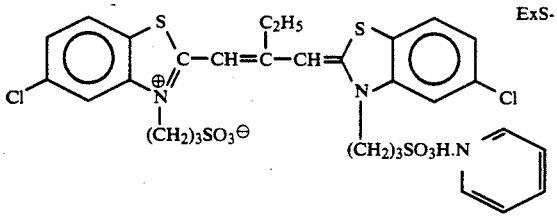
ExS-2
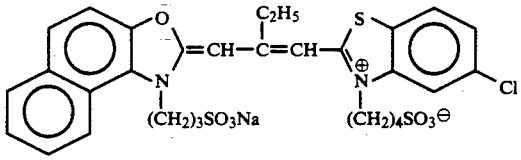
ExS-3
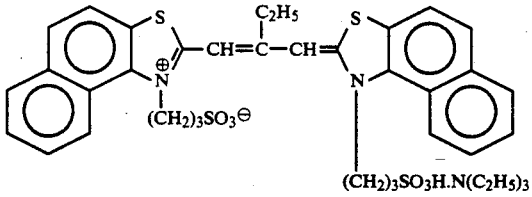
ExS-4
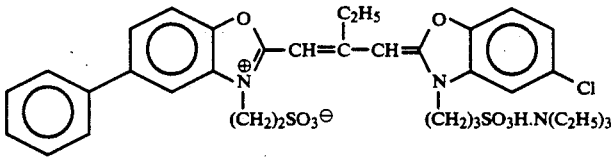
ExS-5
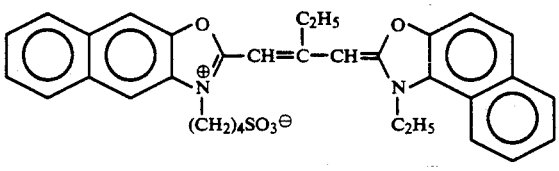

-continued
ExS-6
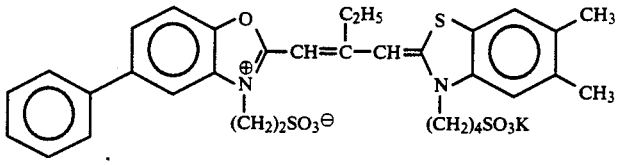
ExS-7
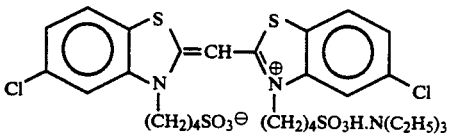
ExS-8
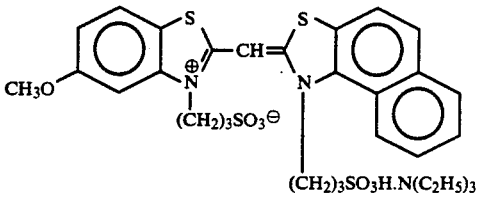
B-1
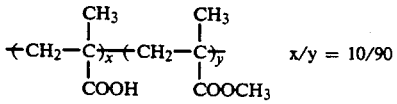
x/y = 10/90
B-2
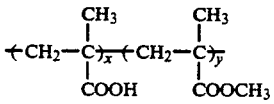
x/y = 40/60
B-3
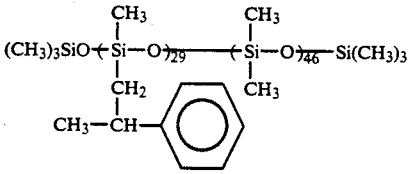
B-4
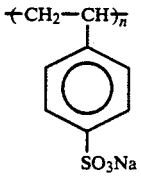
B-5
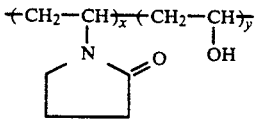
x/y = 70/30
W-1
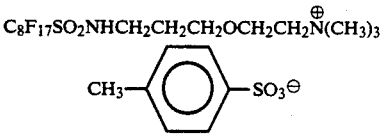
W-2
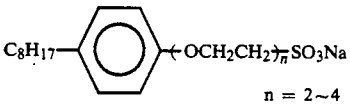
n = 2~4
W-3
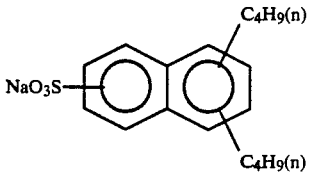
H-1
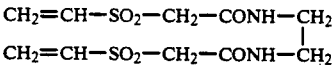
F-1
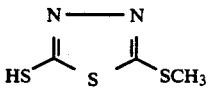
F-2
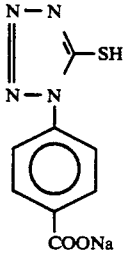
F-3
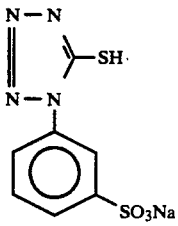
F-4
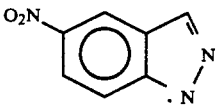
F-5
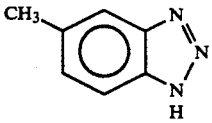

-continued

F-6

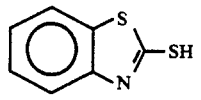

F-7

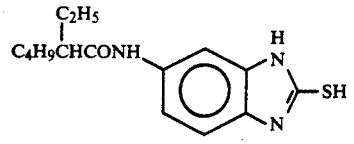

F-8

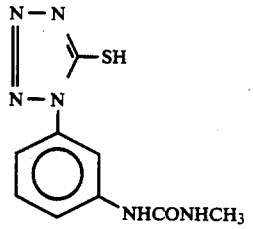

F-9

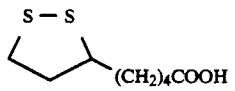

F-10

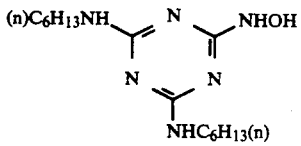

F-11

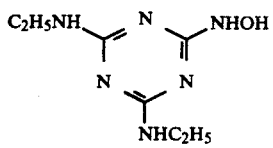

F-12

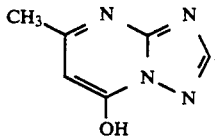

F-13

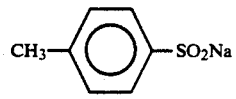

The dry layer thickness excluding that of the support of above Sample 101 was 22 μm and the swelling speed T ½ was 9 seconds.

Sample No. 101 thus prepared was cut to a length of 2 meter with a width of 35 mm. A cut sample was exposed to white light of 50 lux for 0.01 second and then was processed with an automatic developing machine under the following conditions so that the accumulated replenishing amount of the processing solutions was three times as large as that of the tank capacity. Only a stabilizing solution was exchanged in turn, and the respective processings were carried out under the same conditions. After stain of the processed sample was evaluated, it was subjected to a test of its image stabilizing property.

The processing steps and the compositions of the processing solutions are shown below.

| Step | Processing time | Processing temperature (°C.) | Replenishing amount (ml) | Tank capacity (l) |
|---|---|---|---|---|
| | Processing steps | | | |
| Color developing | 3 minutes & 5 seconds | 38.0 | 600 | 17 |
| Bleaching | 50 seconds | 38.0 | 140 | 5 |
| Bleach-fixing | 50 seconds | 38.0 | — | 5 |
| Fixing | 50 seconds | 38.0 | 420 | 5 |
| Washing | 30 seconds | 38.0 | 980 | 3 |
| Stabilizing (1) | 20 seconds | 38.0 | — | 3 |
| Stabilizing (2) | 20 seconds | 38.0 | 560 | 3 |
| Drying | 1 minute | 60 | | |

Note: replenishing amount: per $m^2$ of the light-sensitive material

The stabilizing solution flowed from (2) to (1) in a counter-current system and all of an overflowed solution of washing water was introduced into a fixing bath. All of the overflowed solution effluent from the breaching bath and fixing bath by supplying the replenishing solutions thereto flowed into the bleach-fixing bath as a replenishing solution. The carried-over amounts of the developing solution to the bleaching bath, the bleaching solution to the bleach-fixing bath, the bleach-fixing solution to the fixing bath and the fixing solution to the washing bath were 65, 50, 50 and 50 ml per $m^2$ of the light-sensitive material, respectively. The crossover time was 6 seconds for each and this time was included in the processing time of the preceding bath.

The same solutions as the respective tank solutions were used as the replenishing solutions.

The compositions of the processing solutions are shown below. The unit is gram unless otherwise described.

Color Developing Solution

| | |
|---|---|
| Diethylenetriaminepentaacetic acid | 2.0 |
| 1-Hydroxyethylidene-1,1-diphosphonic acid | 3.3 |
| Sodium sulfite | 3.9 |
| Potassium carbonate | 37.5 |
| Potassium bromide | 1.4 |
| Potassium iodide | 1.3 mg |
| Hydroxylamine sulfate | 2.4 |
| 2-Methyl-4-[N-ethyl-N-(β-hydroxyethyl) amino] aniline sulfate | 4.5 |
| Water was added to make the total quantity | 1 l |
| pH | 10.05 |

Bleaching solution

| | |
|---|---|
| Ferric ammonium 1,3-diaminopropanetetraacetic acid monohydrate | 130 |
| Ammonium bromide | 80 |
| Ammonium nitrate | 15 |
| Hydroxyacetic acid | 50 |
| Acetic acid | 40 |
| Water was added to make the total quantity | 1 l |
| pH was adjusted with aqueous ammonia to | 4.2 |

pH was adjusted with aqueous ammonia to

Bleach-fixing solution

The mixed solution of the above bleaching solution and the following fixing solution in the ratio of 15 to 85 by volume. pH: 7.0.

Fixing Solution

| | |
|---|---|
| Ammonium sulfite | 19 |
| Ammonium thiosulfate aqueous solution (700 g/liter) | 280 ml |
| Imidazole | 15 |
| Ethylenediaminetetraacetic acid | 15 |
| Water was added to make the total quantity | 1 l |
| pH (adjusted with aqueous ammonia and acetic acid) | 7.4 |

Washing water

Tap water was introduced into a mixed-bed type column filled with H type strong acidic cation exchange resins (Amberlite IR-120B manufactured by Rohm & Haas Co., Ltd.) and OH type strong base anion exchange resins (Amberlite IRA-400 manufactured by Rohm & Hass Co., Ltd.) to reduce the ion concentrations of calcium and magnesium to 3 mg/l or less, and subsequently sodium dichloroisocyanurate 20 mg/l and sodium sulfate 150 mg/l were added. The pH range of this solution was 6.5 to 7.5.

Stabilizing solution

| | |
|---|---|
| Sodium p-toluenesulfinate | 0.1 |
| Polyoxyethylene-p-monononylphenyl ether (average polymerization degree: 10) | 0.2 |
| Disodium ethylenediaminetetraacetate | 0.05 |
| Image stabilizer (described in Table A) | 0.01 mole |
| Water was added to make the total quantity | 1 l |
| pH | 7.2 |

Evaluation of image preservability

The magenta densities of the respective samples thus processed were measured with a densitometer FSD 103 manufactured by Fuji Photo Film Co., Ltd. Then, each of the samples was subjected to an again test under the conditions of 25° C. and a relative humidity of 55% for two months and the magenta densities were measured once again in the same manner to obtain the reductions thereof by aging (M fading), wherein the magenda densities of the respective samples after processing were 1.5.

Evaluation of processing stain

Each of the above samples after processing was visually observed to evaluate processing stain. The evaluation results were classified in five ranks:

Rank 1: No stains observed

2: Only a little bit of stain observed (one tenth or less of the sample surface was stained with a slight could)

3: Cloud observed on one tenth or more of the sample surface

4: Substances observed stuck on one tenth or less of the sample surface

5: Substances observed stuck on one tenth or more of the sample surface

Measurement of a formaldehyde vapor concentration

Each 100 ml of the stabilizing solutions prepared by the following procedure was put in a dish (an opening area: 80 $cm^2$), which was settled in a closed glass vessel with a volume of five liters and was left to stand at 20° C. for seven days. Then, the formaldehyde vapor concentration in the glass vessel was measured with an instant reading L type formaldehyde gas detecting tube manufactured by Gastech Co. (HCHO concentration).

The evaluation results are shown in Table A together with the image stabilizing agents used.

TABLE A

| Sample No. | Image Stabilizer | M Fading | Stain | Formaldehyde Vap. Conc. (ppm) |
|---|---|---|---|---|
| 1 (Comp.) | — | 0.30 | 1 | — |
| 2 (Comp.) | formaldehyde | 0.00 | 1 | 5 or more |
| 3 (Comp.) | Comp. Compound (h) | 0.19 | 5 | 5 or more |
| 4 (Comp.) | THHT*1 | 0.02 | 2 | 5 or more |
| 5 (Comp.) | NMP*2 | 0.18 | 3 | 0.4 |
| 6 (Comp.) | NDH*3 | 0.25 | 3 | 5 or more |
| 7 (Comp.) | HMT*4 | 0.27 | 3 | 0.1 or less |
| 8 (Inv.) | I-1*5 | 0.00 | 1 | 0.5 |
| 9 (Inv.) | I-2*5 | 0.01 | 1 | 0.6 |
| 10 (Inv.) | I-3*5 | 0.01 | 1 | 0.6 |
| 11 (Inv.) | I-4*5 | 0.01 | 1 | 0.6 |
| 12 (Inv.) | I-5*5 | 0.02 | 2 | 0.7 |
| 13 (Inv.) | I-26*5 | 0.02 | 1 | 0.7 |
| 14 (Inv.) | I-27*5 | 0.02 | 1 | 0.8 |

*1THHT: tris (2-hydroxyethyl)-1,3,5-hexahydro-s-triazine
*2NMP: N-methylolpyrole
*3NDH: N,N-dimethylolhydantoin
(*1, *2 & *3 described in JP-A-2-153348)
*4HMT: hexamethylenetetramine (described in JP-A-63-244036)
*5Compound of the present invention As can be found from the results shown in Table A, the use of the N-methylol compounds of the present invention can provide the processing method in which the vapor concentration of formaldehyde is reduced, the processed samples have no stains and an excellent image preservability can be attained.

EXAMPLE 2

Sample No. 201 was prepared in the same manner as in the preparation of Sample No. 101 of Example 1, except that ExC-6 shown below was further added to the fifth layer in an amount of $1.0\times10^{-2}$ g/$m^2$ and ExM-4 used in the tenth layer was replaced with ExM-4' shown below in the equal amount.

ExC-6

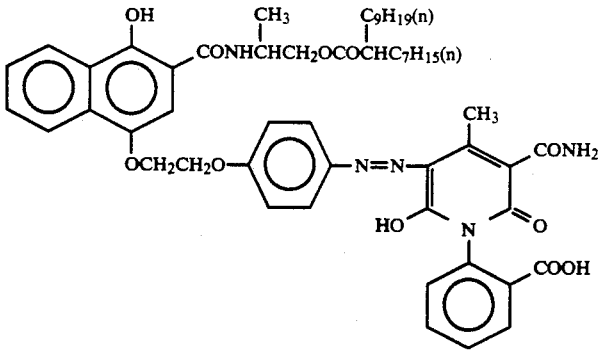

ExM-4'

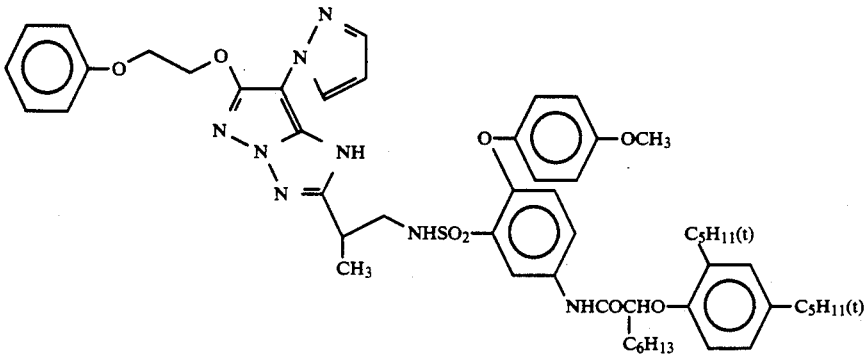

The thus prepared Sample No. 201 was processed in the same manner as in Example 1 except that the image stabilizer used in stabilizing solution was changed shown in Table B, and then was evaluated with respect to the image preservability, processing stain and formaldehyde vapor concentration in the same manner as in Example 1. The results are shown in Table B below.

TABLE B

| Sample No. | Image Stabilizer | M Fading | Stain | Formaldehyde Vap. Conc. (ppm) |
|---|---|---|---|---|
| 1 (Comp.) | — | 0.33 | 1 | — |
| 2 (Comp.) | formaldehyde | 0.00 | 1 | 5 or more |
| 3 (Comp.) | Comp. Compound (a) | 0.20 | 3 | 5 or more |
| 4 (Comp.) | Comp. Compound (b) | 0.21 | 5 | 5 |
| 5 (Comp.) | Comp. Compound (c) | 0.22 | 3 | 4 |
| 6 (Comp.) | Comp. Compound (d) | 0.23 | 3 | 5 |
| 7 (Comp.) | Comp. Compound (e) | 0.26 | 5 | 5 or more |
| 8 (Comp.) | Comp. Compound (f) | 0.25 | 5 | 5 or more |
| 9 (Comp.) | Comp. Compound (g) | 0.24 | 3 | 5 or more |
| 10 (Comp.) | Comp. Compound (h) | 0.20 | 5 | 5 or more |
| 11 (Comp.) | Comp. Compound (i) | 0.05 | 3 | 5 or more |
| 12 (Comp.) | Comp. Compound (j) | 0.30 | 3 | 0.5 or less |
| 13 (Comp.) | Comp. Compound (k) | 0.25 | 3 | 5 or more |
| 14 (Comp.) | Comp. Compound (l) | 0.24 | 4 | 5 or more |
| 15 (Comp.) | Comp. Compound (m) | 0.21 | 1 | 5 or more |
| 16 (Inv.) | II-1 | 0.02 | 1 | 0.9 |
| 17 (Inv.) | II-2 | 0.05 | 1 | 0.1 |
| 18 (Inv.) | II-7 | 0.05 | 1 | 0.1 |
| 19 (Inv.) | II-4 | 0.02 | 1 | 0.4 |
| 20 (Inv.) | II-5 | 0.02 | 1 | 0.5 |
| 21 (Inv.) | II-12 | 0.03 | 1 | 0.6 |
| 22 (Inv.) | II-21 | 0.02 | 1 | 0.6 |
| 23 (Inv.) | II-26 | 0.02 | 1 | 0.5 |

Comparative Compounds (a) to (h) are disclosed above.

Comparative Compound (i)

-continued

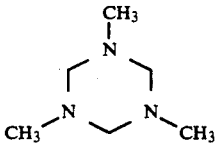

Compound disclosed in JP-A-2-153348

Comparative Compound (j) (HMT of Example 1)

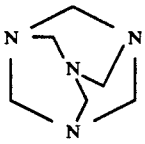

Compound disclosed in JP-A-63-244036

Comparative Compound (k)

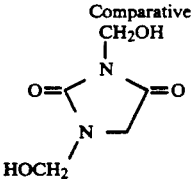

Compound disclosed in U.S. Pat. No. 4,579,436

Comparative Compound (l)

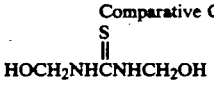

Compound disclosed in U.S. Pat. No. 2,487,446

Comparative Compound (m)

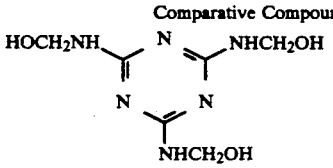

Compound disclosed in U.S. Pat. No. 2,487,569

As can be found from the results shown in Table B, the use of the N-methylol compounds of the present invention can provide the processing method in which the vapor concentration of formaldehyde is reduced, the processing samples have no stains and an excellent image preservability can be attained.

EXAMPLE 3

Sample Nos. 201 and 202 were prepared in the same manner as Example 1, except that the magenta coupler ExM-1 of Sample No. 101 was replaced with equimolar M-1 and M-17, respectively. The samples thus prepared were evaluated in the same manner as in Example 1, and the similar results were obtained.

Further, Sample Nos. 203 and 204 were prepared in the same manner as Example 1, except that the magenta coupler ExM-4 of Sample No. 101 was replaced with equimolar M-1 and an equimolar mixture of ExM-4 and M-1 (1:1), respectively and they were evaluated in the same manner as Example 1 to obtain the similar results.

EXAMPLE 4

Sample No. 101 of Example 1 was processed in the following processing steps and solutions with an automatic developing machine. The processing was continued so that the accumulated replenishing amount of the stabilizing solution was three times as large as that of the tank capacity in Examples 1 and 2. The test of image preservability was carried out and the similar results were obtained.

| | Processing steps | | | |
|---|---|---|---|---|
| Step | Processing Time | Processing Temperature (°C.) | Replenishing Amount (ml) | Tank Capacity (l) |
| Color developing | 3 minutes & 15 seconds | 38 | 33 | 20 |
| Bleaching | 6 minutes & 30 seconds | 38 | 25 | 40 |
| Washing | 2 minutes & 10 seconds | 24 | 1200 | 20 |
| Fixing | 4 minutes & 20 seconds | 38 | 25 | 30 |
| Washing (1) | 1 minute & 5 seconds | 24 | — | 10 |
| Washing (2) | 1 minute | 24 | 1200 | 10 |
| Stabilizing | 1 minute & 5 seconds | 38 | 25 | 10 |
| Drying | 4 minutes & 20 seconds | 55 | | |

Note:
Replenishing amount is per 1 m × 35 mm (width). Washing was done in a counter current system from (2) to (1).

The compositions of the processing solutions are shown below. The unit is gram unless otherwise described.

| | A | B |
|---|---|---|
| Color Developing Solution (unit: g) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethylamino)] 2-methylaniline sulfate | 4.5 | 5.5 |
| Water was added to make the total quantity | 1 l | 1 l |
| pH | 10.05 | 10.10 |
| Bleaching solution | | |
| Ferric sodium ethylenediaminetetraacetic acid trihydrate | 100.0 | 120.0 |
| Disodium ethylenediaminetetraacetic acid | 10.0 | 10.0 |

-continued

| | A | B |
|---|---|---|
| Ammonium bromide | 140.0 | 160.0 |
| Ammonium nitrate | 30.0 | 35.0 |
| Aqueous ammonia (27%) | 6.5 ml | 4.0 ml |
| Water was added to make the total quantity | 1 l | 1 l |
| pH | 6.0 | 5.7 |
| Fixing solution | | |
| Disodium ethylenediaminetetraacetate | 0.5 | 0.7 |
| Sodium sulfite | 7.0 | 8.0 |
| Sodium bisulfite | 5.0 | 5.5 |
| Ammonium thiosulfate aqueous solution (700 g/l) | 170.0 ml | 200.0 ml |
| Water was added to make the total quantity | 1.0 l | 1.0 l |
| pH | 6.7 | 6.6 |
| Stabilizing solution | | |
| Image stabilizer (described in Tables A and B) | 2.0 ml | 3.0 ml |
| Polyoxyethylene-p-monononylphenyl ether (average polymerization degree: 10) | 0.3 | 0.45 |
| Disodium ethylenediaminetetraacetate | 0.05 | 0.08 |
| Water was added to make the total quantity | 1.0 l | 1.0 l |
| pH | 5.0–8.0 | 5.0–8.0 |

Note:
A: mother solution
B: replenishing solution

EXAMPLE 5

Sample No. 101 of Example 1 was processed in Stabilizing Solution No. 1 (containing no image stabilizer) of Example 4 and the bleaching solution prepared by adding Compound I-1 (0.3 mole/liter) to the bleaching solution of Example 4. The processed sample was subjected to evaluation of stain and image preservability to find that the excellent results were obtained similarly to Sample No. 8 of Example 1.

Similarly, Sample No. 201 of Example 2 was processed in the bleaching solution prepared by adding Compound II-1 (0.3 mole/liter) to the bleaching solution of Example 4. The processed sample was subjected to evaluation of stain and image preservability to find that the excellent results were obtained similarly to Sample No. 16 of Example 2.

EXAMPLE 6

Layers having the following compositions were provided on a 127 μm thick cellulose triacetate film support having thereon a subbing layer to thereby prepare a multi-layered color light-sensitive material Sample No. 501. The addition amounts are in terms of g/m². The amount of colloidal silver and silver halides are the amounts converted to silver.

| | |
|---|---|
| First layer: an anti-halation layer | |
| Black colloidal silver | 0.25 |
| Gelatin | 1.9 |
| UV absorber U-1 | 0.04 |
| UV absorber U-2 | 0.1 |
| UV absorber U-3 | 0.1 |
| UV absorber U-4 | 0.1 |
| UV absorber U-6 | 0.1 |
| High-boiling organic solvent Oil-1 | 0.1 |
| Second layer: an intermediate layer | |
| Gelatin | 0.40 |
| Compound Cpd-D | 10 mg |
| High-boiling organic solvent Oil-3 | 0.1 |
| Dye D-4 | 0.4 mg |
| Third layer: an intermediate layer | |
| Silver iodobromide fine grains whose surface and inside were fogged (average grain size: 0.06 μm, a fluctuation coefficient: 18%, AgI content: 1 mole %) | 0.05 |

-continued

| | |
|---|---|
| Gelatin | 0.4 |
| Fourth layer: a low red-sensitive layer | |
| Emulsion A | 0.2 |
| Emulsion B | 0.3 |
| Gelatin | 0.8 |
| Coupler C-1 | 0.15 |
| Coupler C-2 | 0.05 |
| Coupler C-9 | 0.05 |
| Compound Cpd-D | 10 mg |
| High-boiling organic solvent Oil-2 | 0.1 |
| Fifth layer: a medium red-sensitive layer | |
| Emulsion B | 0.2 |
| Emulsion C | 0.3 |
| Gelatin | 0.8 |
| Coupler C-1 | 0.2 |
| coupler C-2 | 0.05 |
| Coupler C-3 | 0.2 |
| High-boiling organic solvent Oil 2 | 0.1 |
| Sixth layer: a high red-sensitive layer | |
| Emulsion D | 0.4 |
| Gelatin | 1.1 |
| Coupler C-1 | 0.3 |
| Coupler C-3 | 0.7 |
| Additive P-1 | 0.1 |
| Seventh layer: an intermediate layer | |
| Gelatin | 0.6 |
| Additive M-1 | 0.3 |
| Anti-stain agent Cpd-K | 2.6 mg |
| UV absorber U-1 | 0.1 |
| UV absorber U-6 | 0.1 |
| Dye D-1 | 0.02 |
| Eighth layer: an intermediate layer | |
| Silver iodobromide fine grains whose surface and inside were fogged (average grain size: 0.06 μm, a fluctuation coefficient: 16%, AgI content: 0.3 mole %) | 0.02 |
| Gelatin | 1.0 |
| Additive P-1 | 0.2 |
| Anti-stain agent CpD-J | 0.1 |
| Anti-stain agent Cpd-A | 0.1 |
| Ninth layer: a low green-sensitive layer | |
| Emulsion E | 0.3 |
| Emulsion F | 0.1 |
| Emulsion G | 0.1 |
| Gelatin | 0.5 |
| Coupler C-7 | 0.05 |
| Coupler C-8 | 0.20 |
| Compound Cpd-B | 0.02 |
| Compound Cpd-D | 10 mg |
| Compound Cpd-E | 0.02 |
| Compound Cpd-F | 0.02 |
| Compound Cpd-G | 0.02 |
| Compound Cpd-H | 0.02 |
| High-boiling organic solvent Oil-1 | 0.1 |
| High-boiling organic solvent Oil-2 | 0.1 |
| Tenth layer: a medium green-sensitive layer | |
| Emulsion G | 0.3 |
| Emulsion H | 0.1 |
| Gelatin | 0.6 |
| Coupler C-7 | 0.2 |
| Coupler C-8 | 0.1 |
| Compound Cpd-B | 0.03 |
| Compound Cpd-E | 0.02 |
| Compound Cpd-F | 0.02 |
| Compound Cpd-G | 0.05 |
| Compound Cpd-H | 0.05 |
| High-boiling organic solvent Oil-2 | 0.1 |
| Eleventh layer: a high green-sensitive layer | |
| Emulsion I | 0.5 |
| Gelatin | 1.0 |
| Coupler C-4 | 0.3 |
| Coupler C-8 | 0.1 |
| Compound Cpd-B | 0.08 |
| Compound Cpd-E | 0.02 |
| Compound Cpd-F | 0.02 |
| Compound Cpd-G | 0.02 |
| Compound Cpd-H | 0.02 |
| High-boiling organic solvent Oil-1 | 0.02 |
| High-boiling organic solvent Oil-2 | 0.02 |
| Twelfth layer: an intermediate layer | |

-continued

| | |
|---|---|
| Gelatin | 0.6 |
| Dye D-1 | 0.1 |
| Dye D-2 | 0.05 |
| Dye D-3 | 0.07 |
| Thirteenth layer: a yellow filter layer | |
| Yellow colloidal silver | 0.1 |
| Gelatin | 1.1 |
| Anti-stain agent Cpd-A | 0.01 |
| High-boiling organic solvent Oil-1 | 0.01 |
| Fourteenth layer: an intermediate layer | 0.6 |
| Gelatin | |
| Fifteenth layer: a low blue-sensitive layer | |
| Emulsion J | 0.4 |
| Emulsion K | 0.1 |
| Emulsion L | 0.1 |
| Gelatin | 0.8 |
| Coupler C-5 | 0.6 |
| Sixteenth layer: a medium blue-sensitive layer | |
| Emulsion L | 0.1 |
| Emulsion M | 0.4 |
| Gelatin | 0.9 |
| Coupler C-5 | 0.3 |
| Coupler C-6 | 0.3 |
| Seventeenth layer: a high blue-sensitive layer | |
| Emulsion N | 0.4 |
| Gelatin | 1.2 |
| Coupler C-6 | 0.7 |
| Eighteenth layer: the first protective layer | |
| Gelatin | 0.7 |
| UV absorber U-1 | 0.04 |
| UV absorber U-2 | 0.01 |
| UV absorber U-3 | 0.03 |
| UV absorber U-4 | 0.03 |
| UV absorber U-5 | 0.05 |
| UV absorber U-6 | 0.05 |
| High-boiling organic solvent Oil-1 | 0.02 |
| Formaldehyde scavenger | |
| Cpd-C | 0.2 |
| Cpd-I | 0.4 |
| Dye D-3 | 0.05 |
| Nineteenth layer: the second protective layer | |
| Colloidal silver | 0.1 mg |
| Silver iodobromide fine grains (average grain size: 0.06 μm, AgI content: 1 mole %) | 0.1 |
| Gelatin | 0.4 |
| Twentieth layer: the third protective layer | |
| Gelatin | 0.4 |
| Polymethyl methacrylate (average grain size: 1.5 μm) | 0.1 |
| Copolymer of methyl methacrylate and acrylic acid (4:6) (average grain size: 1.5 μm) | 0.1 |
| Silicone oil | 0.03 |
| Surfactant W-1 | 3.0 mg |
| Surfactant W-2 | 0.03 |

In addition to the above components, additives F-1 to F-8 were added to all the layers. Further, a gelatin hardener H-1 and surfactants W-3 and W-4 for coating and emulsifying besides and above components were added to each layer.

Further, phenol, 1,2-benzisothiazline-3-one, 2-phenoxyethanol, phenethyl alcohol, and p-hydroxybenzoate butyl ester were added as a fungicide and an anti-mold agent.

The characteristics of silver iodobromide emulsions used in the above examples are shown below:

| Emulsion | Average grain size (μm) | Fluctuation coefficient (%) | AgI content (%) |
|---|---|---|---|
| A, monodispersed tetra-decahedral grains | 0.25 | 16 | 3.7 |
| B, monodispersed cubic, internal latent image | 0.30 | 10 | 3.3 |

-continued

| Emulsion | Average grain size (μm) | Fluctuation coefficient (%) | AgI content (%) |
|---|---|---|---|
| type grains | | | |
| C, monodispersed tetra-decahedral grains | 0.30 | 18 | 5.0 |
| D, polydispersed twinned grains | 0.60 | 25 | 2.0 |
| E, monodispersed cubic grains | 0.17 | 17 | 4.0 |
| F, monodispersed cubic grains | 0.20 | 16 | 4.0 |
| G, monodispersed cubic, internal latent image type grains | 0.25 | 11 | 3.5 |
| H, monodispersed cubic, internal latent image type grains | 0.30 | 9 | 3.5 |
| I, polydispersed tabular grains (average aspect ratio: 4.0) | 0.80 | 28 | 1.5 |
| J, monodispersed tetra-decahedral grains | 0.30 | 18 | 4.0 |
| K, monodispersed tetra-decahedral grains | 0.37 | 17 | 4.0 |
| L, monodispersed cubic, internal latent image type grains | 0.46 | 14 | 3.5 |
| M, monodispersed cubic grains | 0.55 | 13 | 4.0 |
| N, polydispersed tabular grains (average aspect ratio: 7.0) | 1.00 | 33 | 1.3 |

Spectral sensitization of Emulsions A to N

| Emulsion | Sensitizing dye added | Added amount per mol of AgX (g) | Timing to add sensitizing dye |
|---|---|---|---|
| A | S-1 | 0.025 | IV |
| | S-2 | 0.25 | IV |
| B | S-1 | 0.01 | II |
| | S-2 | 0.25 | II |
| C | S-1 | 0.02 | IV |
| | S-2 | 0.25 | IV |
| D | S-1 | 0.01 | IV |
| | S-2 | 0.10 | IV |
| | S-7 | 0.01 | IV |
| E | S-3 | 0.5 | IV |
| | S-4 | 0.1 | IV |
| F | S-3 | 0.3 | IV |
| | S-4 | 0.1 | IV |
| G | S-3 | 0.25 | II |
| | S-4 | 0.08 | II |
| H | S-3 | 0.2 | I |
| | S-4 | 0.06 | I |
| I | S-3 | 0.3 | III |
| | S-4 | 0.07 | III |
| | S-8 | 0.1 | III |
| J | S-6 | 0.2 | I |
| | S-5 | 0.05 | I |
| K | S-6 | 0.2 | I |
| | S-5 | 0.05 | I |
| L | S-6 | 0.22 | II |
| | S-5 | 0.06 | II |
| M | S-6 | 0.15 | IV |
| | S-5 | 0.04 | IV |
| N | S-6 | 0.22 | II |
| | S-5 | 0.06 | II |

I: during grain formation
II: immediately after finishing grain formation
III: immediately before starting chemical sensitization
IV: immediately after finishing the chemical sensitization

C-1

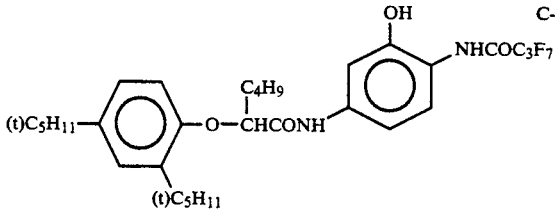

C-2

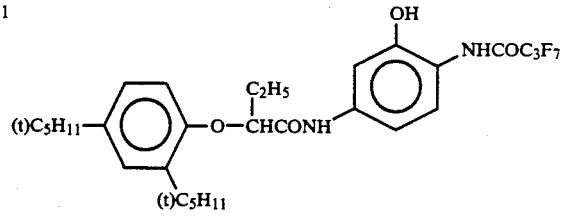

C-3

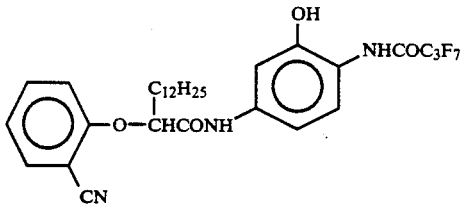

C-4

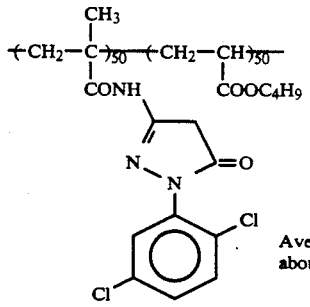

Average Molecular Weight: about 25,000

C-5

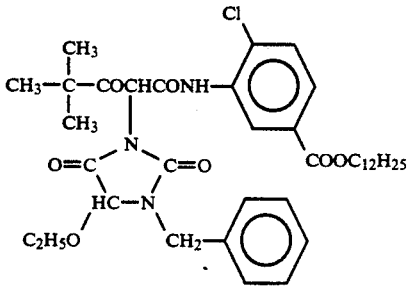

C-6

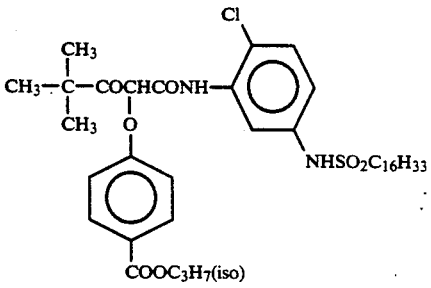

-continued
C-7
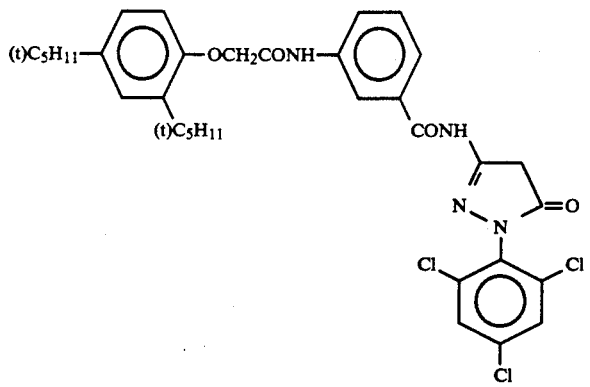
C-8
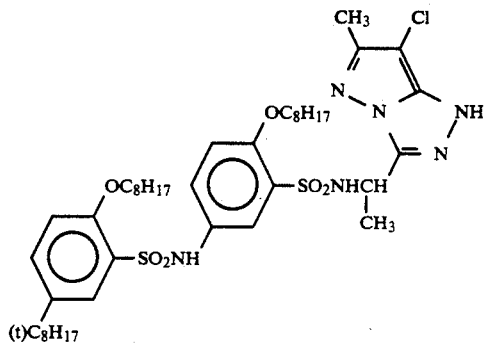
C-9
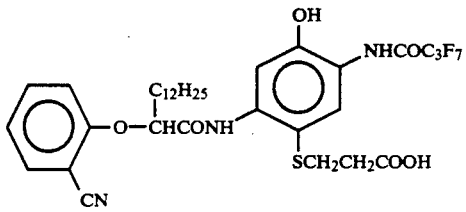
Dibutyl Phthalate Oil-1
Tricresyl Phosphate Oil-2
Oil-3
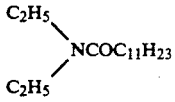
Cpd-A
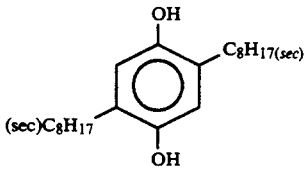
Cpd-B
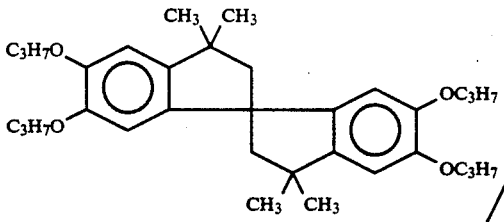
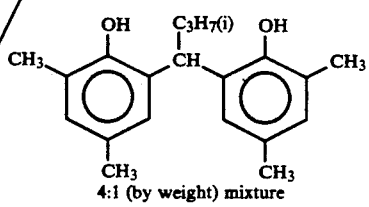
4:1 (by weight) mixture
Cpd-C
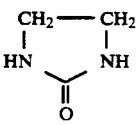
Cpd-D
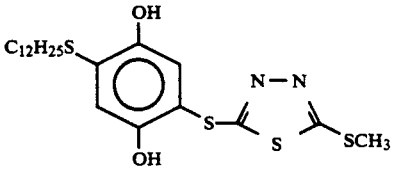

-continued
Cpd-E
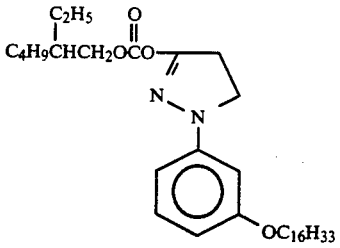
Cpd-F
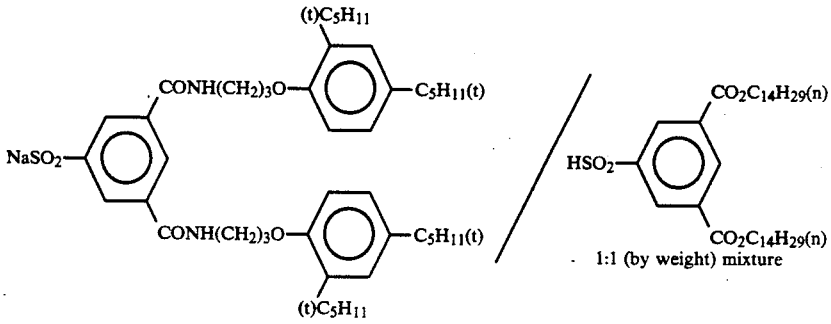
1:1 (by weight) mixture
Cpd-G
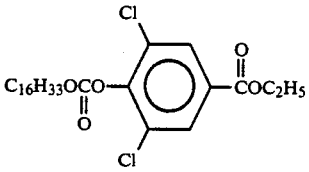
Cpd-H
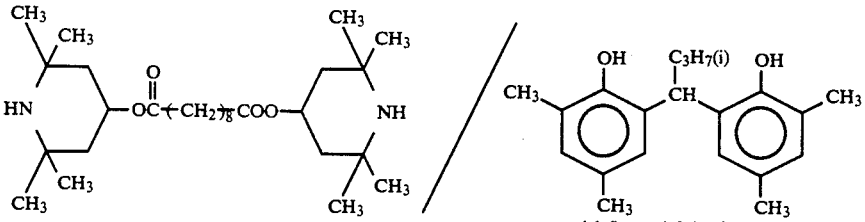
4:1 (by weight) mixture
Cpd-I
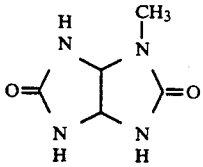
Cpd-J
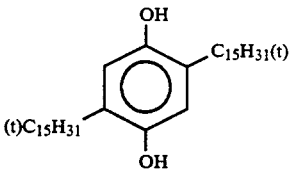
Cpd-K
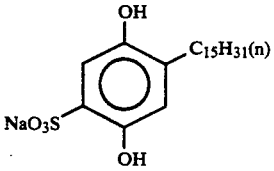
U-1
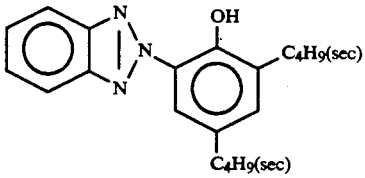
U-2
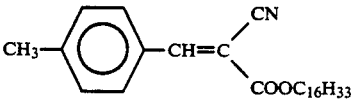
U-3
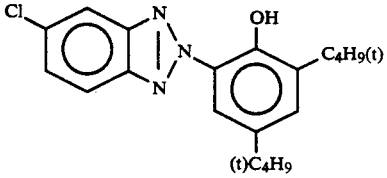

-continued
U-4
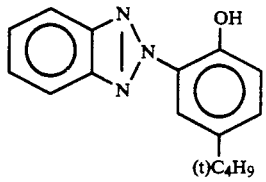
U-5
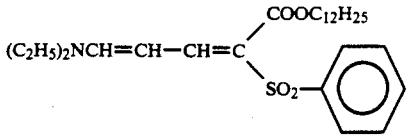
U-6
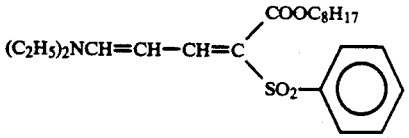
S-1
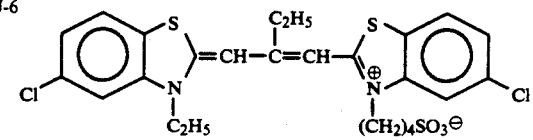
S-2
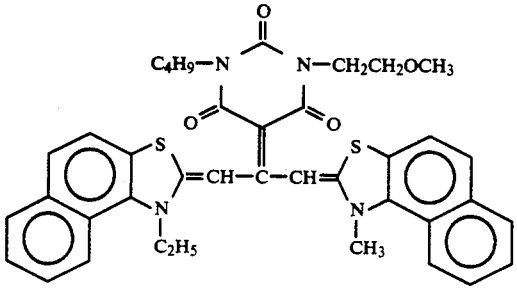
S-3
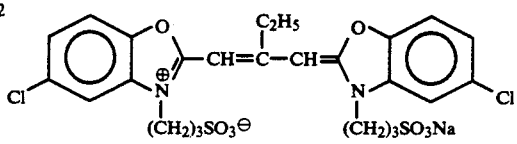
S-4
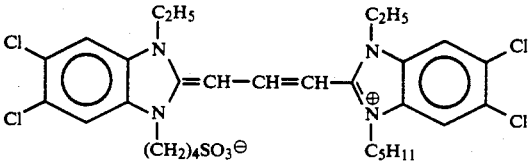
S-5
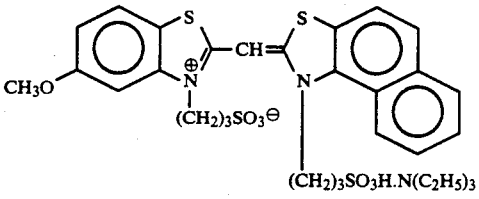
S-6
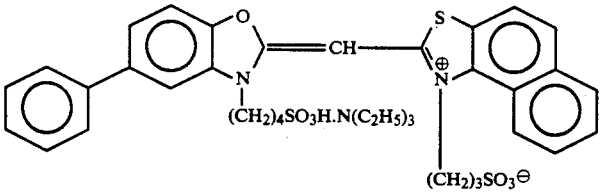
S-7
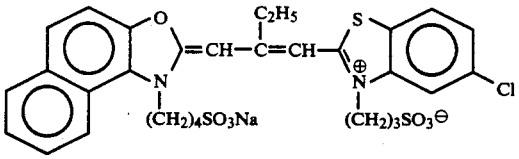
S-8
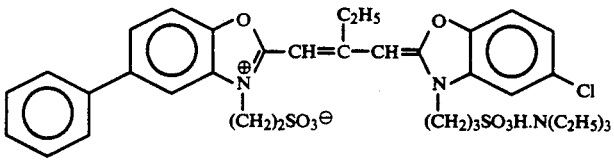
D-1
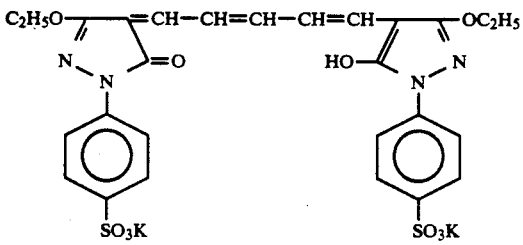
D-2
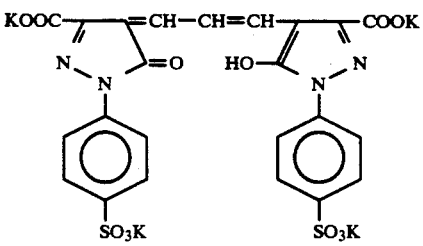

-continued
D-3
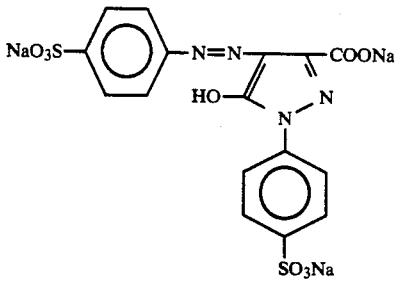
D-4
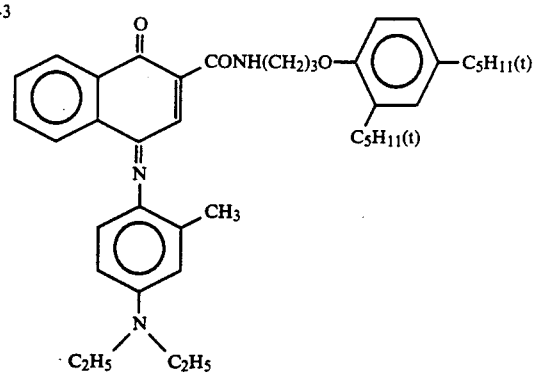
H-1
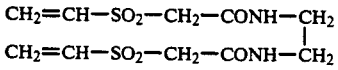
W-1
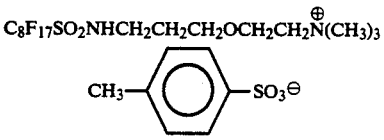
W-2
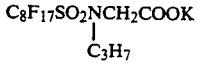
W-3
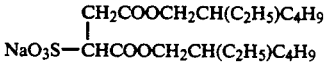
W-4
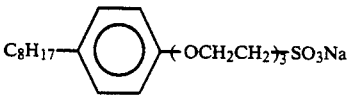
P-1
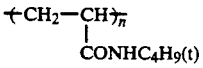
M-1
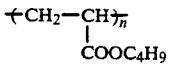
F-1
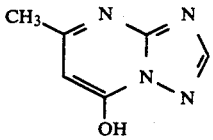
F-2
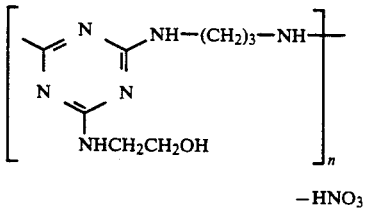
F-3
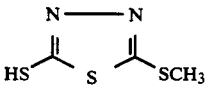
F-4
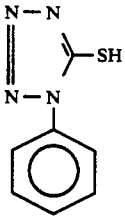
F-5
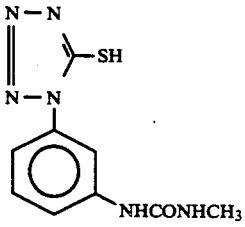
F-6
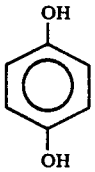
F-7
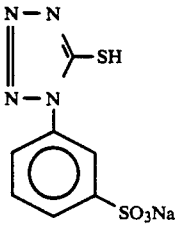

-continued

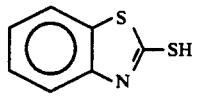

F-8

The above Sample No. 501 was subjected to an imagewise exposure and then to processing with a cine type automatic developing machine according to the following processing steps. A half of the sample was first processed with Bleaching solution 1 and then with the respective stabilizing solutions. The same procedure was repeated to the other half of the sample with Bleaching Solution 2. The samples thus processed were evaluated in the same manner as in Example 1.

| | Processing steps | | | |
|---|---|---|---|---|
| Step | Time (minute) | Temperature (°C.) | Replenishing Amount (ml) | Tank Capacity (l) |
| Black/white developing | 6 | 38 | 1.5 | 12 |
| 1st Washing | 1 | 38 | 7.5 | 4 |
| Reversal | 1 | 38 | 1.1 | 4 |
| Color developing | 4 | 38 | 2.0 | 12 |
| Conditioning | 2 | 38 | 1.1 | 4 |
| Bleaching | 4 | 38 | 1.3 | 12 |
| Fixing | 3 | 38 | 1.3 | 12 |
| 2nd Washing (1) | 1 | 38 | — | 4 |
| 2nd Washing (2) | 1 | 38 | 7.5 | 4 |
| Stabilizing | 1 | 38 | 1.1 | 4 |
| Drying | 2 | 50 | | |

Replenishing amount: per $m^2$ of the light-sensitive material

The overflowed solution of the second washing bath (2) was introduced into the second washing bath (1).

The compositions of the respective processing solutions are shown below. The unit is grain unless otherwise described.

| Black/white developing solution | Start Soln. | Replenishing Soln. |
|---|---|---|
| Pentasodium nitrilo-N,N,N-trimethylenephosphonate | 2.0 | 2.0 |
| Pentasodium diethylenetriamine pentaacetate | 3.0 | 3.0 |
| Potassium sulfite | 30 | 30 |
| Hydroquinone potassium monosulfonate | 20 | 20 |
| Potassium carbonate | 33 | 33 |
| 1-Phenyl-4-methyl-4-hydroxymethyl-3-pyrazolidone | 2.0 | 2.0 |
| Potassium bromide | 2.5 | 0.9 |
| Potassium thiocyanate | 1.2 | 1.2 |
| Potassium iodine | 2.0 mg | 2.0 mg |
| Water was added to make | 1.0 l | 1.0 l |
| pH (25° C.) | 9.60 | 9.70 |

The pH was adjusted with hydrochloric acid or potassium hydroxide.

| Reversal solution | Start Soln./ Replenishing Solution Common |
|---|---|
| Pentasodium nitrilo-N,N,N-trimethylenephosphonate | 2.0 |
| Stannous chloride dihydrate | 1.0 |
| p-Aminophenol | 0.1 |
| Sodium hydroxide | 8.0 |

-continued

| Reversal solution | Start Soln./ Replenishing Solution Common |
|---|---|
| Glacial acetic acid | 15 ml |
| Ammonium sulfite | 20 |
| Water was added to make | 1.0 l |
| pH (25° C.) | 6.60 |

The pH was adjusted with acetic acid or aqueous ammonia.

| Color Developing Solution | Start soln. | Replenishing soln. |
|---|---|---|
| Pentasodium nitrilo-N,N,N-trimethylenephosphonate | 2.0 | 2.0 |
| Pentasodium diethylenetriaminepentaacetate | 2.0 | 2.0 |
| Sodium sulfite | 7.0 | 7.0 |
| Tripotassium phosphate 12 hydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-ethyl-(β-methanesulfonamidethyl)-3-methyl-4-aminoanline sulfate | 10.5 | 10.5 |
| 3,6-Dithiaoctane-1,8-diol | 3.5 | 45 |
| Water was added to make | 1.0 l | 1.0 l |
| pH (25° C.) | 11.90 | 12.05 |

The pH was adjusted with hydrochloric acid or potassium hydroxide.

| Conditioning Solution | Start Soln./Replenishing Solution Common |
|---|---|
| Disodium ethylenediamine tetraacetate dihydrate | 8.0 |
| Sodium sulfite | 12 |
| 2-Mercapto-1,3,4-triazole | 0.5 |
| pH (25° C.) | 6.00 |

The pH was adjusted with hydrochloric acid or sodium hydroxide.

| Bleaching Solution 1 | Start Soln./ Replenishing Solution Common |
|---|---|
| Ethylenediaminetetraacetic acid | 3 |
| Ferric ammonium ethylenediamine-tetraacetate dihydrate | 150 |
| 2-Mercapto-1,3,4-triazole | 0.5 |
| Ammonium bromide | 120 |
| Ammonium nitrate | 25 |
| Water was added to make | 1.0 l |
| pH (25° C.) | 4.20 |

The pH was adjusted with acetic acid or aqueous ammonia.

| Bleaching Solution 2 | Start Soln./ Replenishing Solution Common |
|---|---|
| 1,3-Diaminopropanetetraacetic | 3 |

-continued

| Bleaching Solution 2 | Start Soln./ Replenishing Solution Common |
|---|---|
| acid | |
| Ferric ammonium 1,3-diamino-propanetetraacetic acid dihydrate | 120 |
| Glycolic acid | 40 |
| Acetic acid | 30 |
| Ammonium bromide | 120 |
| Ammonium nitrate | 25 |
| Water was added to make | 1.0 l |
| pH (25° C.) | 4.20 |

The pH was adjusted with acetic acid or aqueous ammonia.

| Fixing Solution | Start Soln./ Replenishing Solution Common |
|---|---|
| Disodium ethylenediaminetetraacetate dihydrate | 1.7 |
| Sodium benzoaldehyde-o-sulfonate | 20 |
| Sodium bisulfite | 15 |
| Ammonium thiosulfate (700 g/l) | 250 ml |
| Water was added to make | 1.0 l |
| pH (25° C.) | 6.00 |

The pH was adjusted with acetic acid or aqueous ammonia.

Stabilizing Solution

The respective stabilizing solutions used in Example 1 or 2 were used (a start solution/a replenishing solution common).

The image preservability was evaluated on the grey-developed portions of the respective processed samples, in which the magenta densities were 0.5.

The results were similar to those in Examples 1 and 2, that is, excellent results were obtained with the stabilizing solutions containing the N-methylol compounds of the present invention.

Further, the samples were processed according to the above processing procedure, in which were used a stabilizing solution containing no image stabilizer and a conditioning solution containing each 0.03 mole/l of the image stabilizers shown in Table C. The respective samples thus processed were subjected to an evaluation of image preservability as well as the above. The results are shown in Table C.

TABLE C

| Sample No. | Image stabilizer | Image preservability* Bleaching Solution 1 | Bleaching Solution 2 |
|---|---|---|---|
| 1 (Comp.) | — | 0.20 | 0.20 |
| 2 (Comp.) | Formaldehyde | 0 | 0 |
| 3 (Inv.) | Compound I-1 | 0.01 | 0 |
| 4 (Inv.) | Compound I-2 | 0.02 | 0.01 |
| 5 (Inv.) | Compound I-3 | 0.02 | 0.01 |
| 6 (Inv.) | Compound I-4 | 0.02 | 0.01 |
| 7 (Inv.) | Compound I-5 | 0.02 | 0.01 |
| 8 (Inv.) | Compound I-26 | 0.02 | 0.01 |
| 9 (Inv.) | Compound I-27 | 0.02 | 0.01 |
| 10 (Inv.) | Compound II-1 | 0.03 | 0.02 |
| 11 (Inv.) | Compound II-2 | 0.05 | 0.04 |
| 12 (Inv.) | Compound II-5 | 0.03 | 0.02 |
| 13 (Inv.) | Compound II-7 | 0.04 | 0.04 |
| 14 (Inv.) | Compound II-12 | 0.03 | 0.02 |

*M fading

As can be found from the results shown in Table C, the application of the N-methylol compounds of the present invention to the conditioning bath can also provide sufficient anti-fading effect for a magenta dye. The excellent results were obtained especially when a ferric complex salt of 1,3-diaminopropanetetraacetic acid was used.

The surfaces of the respective samples in Table C were observed only to find that no stains were observed thereon.

EXAMPLE 7

Sample No. 201 in Example 2 of JP-A-2-90151 and the light-sensitive material 1 in Example 1 and the light-sensitive material 9 in Example 3 of JP-A-2-93641, each of which was used as a light-sensitive material, was subjected to processing Nos. 8 and 16 of Example 1 above. The results showed that the formaldehyde vapor concentration decreased while an excellent anti-fading effect to a dye image was demonstrated and no stains were observed on the light-sensitive material.

While the invention has been described in detail and with reference to specific embodiments thereof, it will be apparent to one skilled in the art that various changes and modifications can be made therein without departing from the spirit and scope thereof.

What is claimed is:

1. A color image stabilizing solution for a silver halide color photographic material, said solution containing an N-methylol compound represented by the following formula: (I):

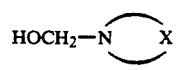

(I)

wherein X represents a group of non-metallic atoms necessary to form a 1H-pyrazole ring or 1H-1,2,4-triazole ring together with the nitrogen atom.

2. The color image stabilizing solution as in claim 1, wherein the N-methylol compound has a total number of carbon atoms of 15 or less.

3. The color image stabilizing solution as in claim 1, wherein the solution contains the N-methylol compound in an amount of 0.003 to 0.1 mol per liter.

4. The color image stabilizing solution as in claim 1, wherein the N-methylol compound according to formula (I) is represented by the following formula (Ia):

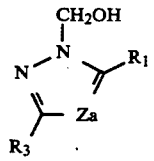

(Ia)

wherein Za represents —N=, —CH=or —C($R_2$)=; $R_1$, $R_2$ and $R_3$ may be the same or different, and each represents a hydrogen atom, an alkyl group, an alkenyl group, an aryl group, a heterocyclic group, a halogen atom, a nitro group, a cyano group, a sulfo group, a carboxyl group, a phospho group, an acyl group, a sulfonyl group, a sulfinyl group, an acyloxy group, an alkoxycarbonyl group, a carbamoyl group, a sulfamoyl group, an amino group, or —Y-Ra, in which Y represents an oxygen atom or a sulfur atom, and Ra represents an alkyl group, an alkenyl group, an aryl group or a heterocyclic group; the above groups may be further substituted; and $R_1$ and $R_2$ or $R_2$ and $R_3$ may combine with each other to form a 5- to 7-membered ring.

5. The color image stabilizing solution as in claim 4, wherein $R_1$, $R_2$ and $R_3$ each represents a hydrogen atom, an alkyl group, an alkenyl group, a halogen atom, a sulfo group, a carboxyl group, an acyloxy group, an amino group, an alkoxy group or an alkylthio group.

6. The color image stabilizing solution as in claim 4, wherein $R_1$, $R_2$ and $R_3$ each represents a hydrogen atom or an unsubstituted alkyl group having 1 to 3 carbon atoms.

7. The color image stabilizating solution as in claim 4, wherein all of $R_1$, $R_2$ and $R_3$ are hydrogen atoms.

8. A method for processing an image-wise exposed silver halide color photographic material, which comprises processing the photographic material with a color image stabilizing solution containing an N-methylol compound represented by the following formula (I):

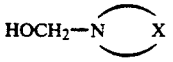

(I)

wherein X represents a group of non-metallic atoms necessary to form a 1H-pyrazole ring or 1H-1,2,4-triazole ring together with the nitrogen atom.

9. The method for processing an image-wise exposed silver halide color photographic material as in claim 8, wherein the N-methylol compound has a total number of carbon atoms of 15 or less.

10. The method for processing an image-wise exposed silver halide color photographic material as in claim 8, wherein the processing solution contains the N-methylol compound in an amount of 0.003 to 0.1 mol per liter.

11. The method for processing an image-wise exposed silver halide color photographic material as in claim 8, wherein said silver halide color photographic material contains at least one tetraequivalent magenta coupler.

12. The method for processing an image-wise exposed silver halide color photographic material as in claim 8, wherein the N-methylol compound according to formula (I) is represented by the following formula (Ia):

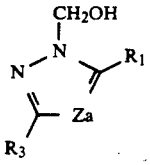

(Ia)

wherein Za represents —N=,—CH=or —C($R_2$)=; $R_1$, $R_2$ and $R_3$ may be the same or different, and each represents a hydrogen atom, an alkyl group, an alkenyl group, an aryl group, a heterocyclic group, a halogen atom, a nitro group, a cyano group, a sulfo group, a carboxyl group, a phospho group, an acyl group, a sulfonyl group, a sulfinyl group, an acyloxy group, an alkoxycarbonyl group, a carbamoyl group, a sulfamoyl group, an amino group, or —Y—Ra, in which Y represents an oxygen atom or a sulfur atom, and Ra represents an alkyl group, an alkenyl group, an aryl group or a heterocyclic group; the above groups may be further substituted; and $R_1$ and $R_2$ or $R_2$ and $R_3$ may combine with each other to form a 5- to 7-membered ring.

13. The method for processing an image-wise exposed silver halide color photographic material as in claim 12, wherein $R_1$, $R_2$ and $R_3$ each represents a hydrogen atom, an alkyl group, an alkenyl group, a halogen atom, a sulfo group, a carboxyl group, an acyloxy group, an amino group, an alkoxy group or an alkylthio group.

14. The method for processing an image-wise exposed silver halide color photographic material as in claim 12, wherein $R_1$, $R_2$ and $R_3$ each represents a hydrogen atom or an unsubstituted alkyl group having 1 to 3 carbon atoms.

15. The method for processing an image-wise exposed silver halide color photographic material as in claim 12, wherein all of $R_1$, $R_2$ and $R_3$ are hydrogen atoms.

16. A method for processing an image-wise exposed silver halide color photographic material, which comprises processing the photographic material while replenishing with a replenishing stabilizing solution containing an N-methylol compound represented by the following formula (I):

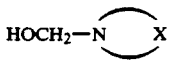

(I)

wherein X represents a group of non-metallic atoms necessary to form a 1H-pyrazole ring or 1H-1,2,4-triazole ring together with the nitrogen atom.

* * * * *